US011263976B2

(12) United States Patent
Yang et al.

(10) Patent No.: US 11,263,976 B2
(45) Date of Patent: Mar. 1, 2022

(54) DISPLAY DEVICE AND METHOD OF DRIVING THE SAME

(71) Applicant: SAMSUNG DISPLAY CO., LTD., Yongin-si (KR)

(72) Inventors: Jin Wook Yang, Yongin-si (KR); Ji Hye Kim, Yongin-si (KR); Young Ha Sohn, Yongin-si (KR); Dong Gyu Lee, Yongin-si (KR); Jae Hyeon Jeon, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

(21) Appl. No.: 17/027,876

(22) Filed: Sep. 22, 2020

(65) Prior Publication Data

US 2021/0248961 A1 Aug. 12, 2021

(30) Foreign Application Priority Data

Feb. 6, 2020 (KR) ..... 10-2020-0014326

(51) Int. Cl.
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0426* (2013.01); *G09G 2300/0809* (2013.01); *G09G 2310/0202* (2013.01); *G09G 2310/06* (2013.01); *G09G 2320/0233* (2013.01)

(58) Field of Classification Search
None
See application file for complete search history.

(56) References Cited

U.S. PATENT DOCUMENTS 11,049,458 B1 * 6/2021 Fan ..... G09G 3/3258
2008/0111774 A1 5/2008 Iida et al.
2011/0193855 A1 * 8/2011 Han ..... G09G 3/3233 345/214

(Continued)

FOREIGN PATENT DOCUMENTS

EP 1591993 11/2005
EP 3343552 7/2018

(Continued)

OTHER PUBLICATIONS

European Search Report issued from the European Patent Office dated Apr. 13, 2021 in corresponding European Patent Application No. 21155599.0 filed on Feb. 5, 2021.

*Primary Examiner* — Nitin Patel
*Assistant Examiner* — Amen W Bogale
(74) *Attorney, Agent, or Firm* — F. Chau & Associates, LLC

(57) ABSTRACT

A display device includes a first transistor including a first electrode connected to a first power line, a second electrode connected to a third node, and a gate electrode connected to a first node, a first capacitor formed between the first power line and a second node, a second capacitor formed between the first node and the second node, an emission transistor including a first electrode connected to the third node, a second electrode, and a gate electrode connected to an emission control line, and a light emitting element connected to the second electrode of the emission transistor and a second power line.

20 Claims, 22 Drawing Sheets

(56) References Cited

U.S. PATENT DOCUMENTS

| | | | | |
|---|---|---|---|---|
| 2011/0199357 | A1 | 8/2011 | Chung et al. | |
| 2014/0192037 | A1* | 7/2014 | Chung | G09G 3/2022 345/212 |
| 2015/0348464 | A1* | 12/2015 | In | G09G 3/2022 345/205 |
| 2016/0055792 | A1* | 2/2016 | Lee | G09G 3/3233 315/173 |
| 2017/0061876 | A1* | 3/2017 | Cho | G09G 3/3258 |
| 2017/0124954 | A1* | 5/2017 | Park | H01L 27/3244 |
| 2017/0199616 | A1* | 7/2017 | Kim | G09G 3/3266 |
| 2018/0293939 | A1 | 10/2018 | Kim et al. | |
| 2019/0096330 | A1 | 3/2019 | Kim et al. | |
| 2019/0295470 | A1* | 9/2019 | Kim | G09G 3/3258 |
| 2020/0202771 | A1* | 6/2020 | Takasugi | G09G 3/32 |
| 2020/0302860 | A1* | 9/2020 | Kim | G09G 3/3266 |
| 2021/0049965 | A1* | 2/2021 | Jeon | G09G 3/3233 |
| 2021/0065619 | A1* | 3/2021 | Kim | G09G 3/3233 |
| 2021/0065628 | A1* | 3/2021 | Kim | G09G 3/3233 |
| 2021/0142735 | A1* | 5/2021 | Cho | G09G 3/3233 |

FOREIGN PATENT DOCUMENTS

| | | |
|---|---|---|
| KR | 10-2010-0072433 | 7/2010 |
| KR | 1020110122410 | 10/2011 |
| KR | 10-1816891 | 1/2018 |
| KR | 10-2018-0114981 | 10/2018 |
| KR | 10-2019-0034375 | 4/2019 |
| KR | 10-1978798 | 5/2019 |

* cited by examiner

Vg = VINIT
Va = previous Frame Data $Vg = VDD - Vth + \alpha$ $Va = VREF$

Vg = VINIT
Va = VREF $Vg = VDD - Vth$
$Va = VREF$ $$Vg = VDD - Vth + (DATA - VREF)$$
$$Va = DATA$$

DISPLAY DEVICE AND METHOD OF DRIVING THE SAME

CROSS-REFERENCE TO RELATED APPLICATIONS

The present application claims priority under 35 U.S.C. § 119(a) to Korean Patent Application No. 10-2020-0014326, filed on Feb. 6, 2020 in the Korean Intellectual Property Office, the disclosure of which is incorporated by reference herein in its entirety.

TECHNICAL FIELD

Exemplary embodiments of the present disclosure generally relate to a display device and a method of driving the same.

DISCUSSION OF THE RELATED ART

A display device includes pixels, each of which may include a light emitting diode which emits light with a luminance corresponding to a driving current and a driving transistor which controls the driving current in response to a data voltage. Since a threshold voltage of the driving transistor varies, the display device writes the data voltage to the pixel during a data write period, and simultaneously compensates for the data voltage by the threshold voltage of the driving transistor.

The resolution and driving frequency (or the reproduction factor of an image) of the display device may increase. Accordingly, the width of the data write period may be narrowed, and the data voltage may not be appropriately compensated during the data write period. Thus, there has been research regarding various techniques and structures of the pixel, which are used to compensate for the data voltage, corresponding to the increase in resolution and driving frequency of the display device.

SUMMARY

Exemplary embodiments provide a display device capable of sufficiently compensating for a data voltage by considering a threshold voltage of a driving transistor, and a method of driving the display device.

In accordance with an aspect of the present disclosure, a display device includes a first power line, a second power line, a reference power line, an initialization power line, a data line configured to transfer a data signal, a first scan line configured to transfer a scan signal, a first gate line and a second gate line configured to sequentially transfer a gate signal, an emission control line configured to transfer an emission control signal, and a pixel. The pixel includes a first transistor including a first electrode connected to the first power line, a second electrode connected to a third node, and a gate electrode connected to a first node. The pixel further includes a first capacitor formed between the first power line and a second node, and a second capacitor formed between the first node and the second node. The pixel further includes a second transistor including a third electrode connected to the data line, a fourth electrode connected to the second node, and a gate electrode connected to the first scan line. The pixel further includes a third transistor including a fifth electrode connected to the first node, a sixth electrode connected to the third node, and a gate electrode connected to the first gate line. The pixel further includes a fourth transistor including a seventh electrode connected to the first node, an eighth electrode connected to the initialization power line, and a gate electrode connected to the second gate line. The pixel further includes a fifth transistor including a ninth electrode connected to the second node, a tenth electrode connected to the reference power line, and a gate electrode connected to the first gate line. The pixel further includes a sixth transistor including an eleventh electrode connected to the third node, a twelfth electrode, and a gate electrode connected to the emission control line. The pixel further includes a light emitting element connected between the twelfth electrode of the sixth transistor and the second power line.

At least one among the second transistor, the third transistor, the fourth transistor, and the fifth transistor may be implemented as a dual gate transistor including a plurality of sub-transistors connected in series.

The display device may further include a scan driver configured to provide the gate signal having a gate-on voltage level to the second gate line in a first period and a third period, configured to provide the gate signal having the gate-on voltage to the first gate line in a second period and a fourth period, and configured to provide the scan signal having a gate-on voltage level to the first scan line in a scan period. The first period, the second period, the third period, and the fourth period may be sequentially located in one frame.

The one frame may include a non-emission period and an emission period. The first period, the second period, the third period, the fourth period, and the scan period may be included in the non-emission period, and do not overlap one another. The scan driver may provide the emission control signal having a gate-on voltage level to the emission control line in the emission period.

A width of each of the first to fourth periods may be three or more times a width of the scan period.

The width of each of the first to fourth periods may be four times of a width of the scan period.

The width of scan period may be one horizontal time interval.

In the second period, the first node may have a voltage corresponding to a difference between a first power voltage applied to the first power line and a threshold voltage of the first transistor. The voltage of the first node may be changed depending on a previous data voltage of a previous frame. In the fourth period, the first node may have a voltage substantially equal to the difference between the first power voltage and the threshold voltage of the first transistor.

A bias or operation point of the first transistor in the scan period may be equal to that of the first transistor in the emission period.

The display device may further include a seventh transistor including a thirteenth electrode connected to the initialization power line, a fourteenth electrode connected to an anode electrode of the light emitting element, and a gate electrode connected to a second scan line. The scan driver may provide the scan signal having the gate-on voltage level to the second scan line after the scan period.

The scan signal provided to the second scan line may have a waveform in which the scan signal provided to the first scan line is shifted by the scan period.

Between the fourth period and the scan period, the scan driver may further sequentially provide the gate signal having the gate-on voltage level to the second gate line and the first gate line.

The gate signal provided to the first gate line may have a waveform in which the gate signal provided to the second gate line is shifted by the first period.

The gate signal provided to the second gate line may include a plurality of pulses having a gate-on voltage level.

Each of the pulses may have the same pulse width. The gate signal provided to the first gate line may have a waveform in which the gate signal provided to the second gate line is shifted by the pulse width.

In accordance with an aspect of the present disclosure, a method of driving a display device including a first transistor including a first electrode connected to a first power line, a second electrode connected to a third node, and a gate electrode connected to a first node, a first capacitor formed between the first power line and a second node, a second capacitor connected between the first node and the second node, an emission transistor including a first electrode connected to the third node and a gate electrode connected to an emission control line, and a light emitting element connected to a second electrode of the emission transistor and a second power line, may include the following operations. The method may include primarily applying an initialization voltage to the first node during a first period, primarily applying a reference voltage to the second node in a state in which the second electrode of the first transistor and the gate electrode of the first transistor are connected, during a second period, secondarily applying the initialization voltage to the first node during a third period, secondarily applying the reference voltage to the second node in a state in which the second electrode of the first transistor and the gate electrode of the first transistor are connected, during a fourth period, applying a data voltage to the second node during a scan period, and turning on the emission transistor during an emission period.

The first to fourth periods may be included in a non-emission period of one frame, and do not overlap one another.

A width of each of the first to fourth periods may be three or more times a width of that of the scan period.

The width of scan period may be one horizontal time interval.

The method may further include, between the fourth period and the scan period, tertiarily applying the initialization voltage to the first node, and tertiarily applying the reference voltage to the second node.

BRIEF DESCRIPTION OF THE DRAWINGS

The above and other features of the present disclosure will become more apparent by describing in detail exemplary embodiments thereof with reference to the accompanying drawings, in which.

DETAILED DESCRIPTION

Figure 1:
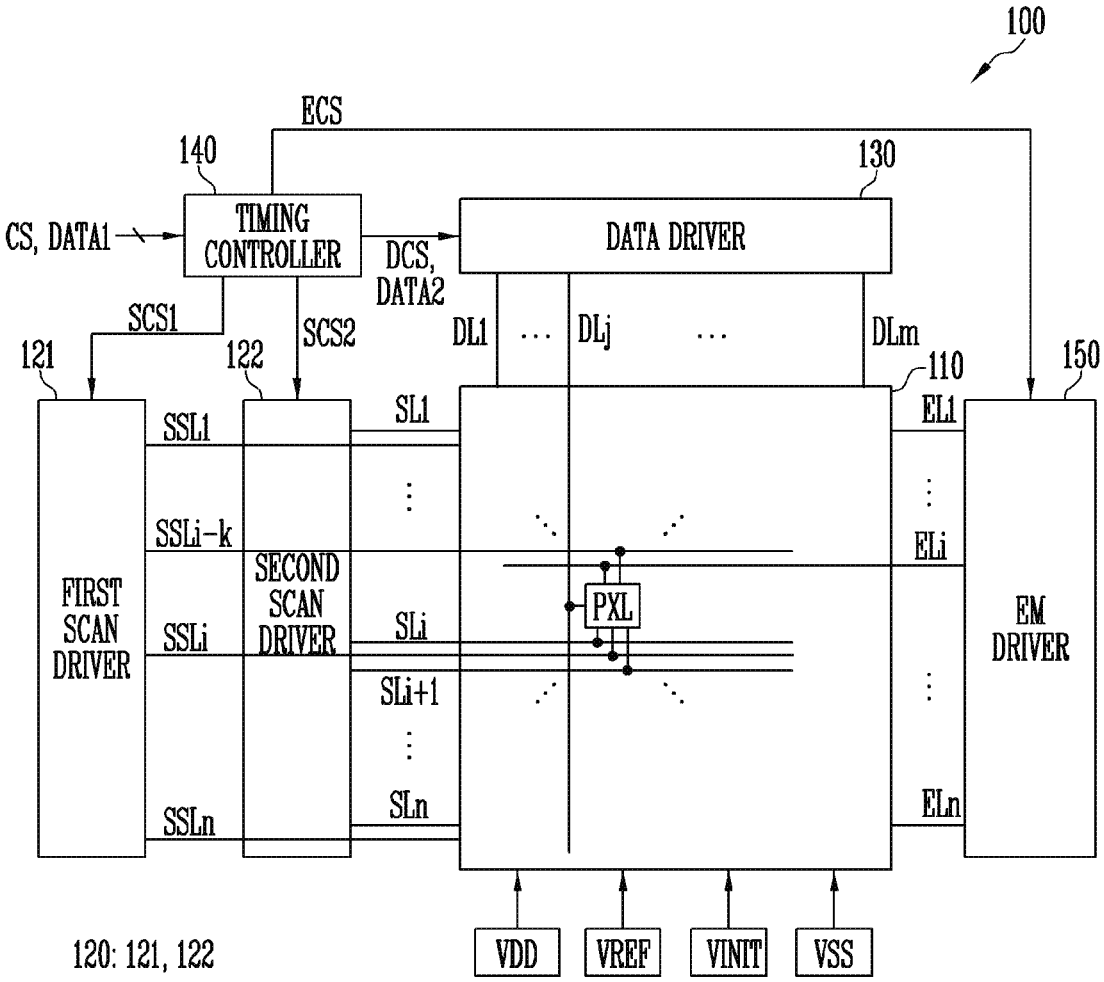
FIG. 1 is a diagram illustrating a display device in accordance with an exemplary embodiment of the present disclosure.

Exemplary embodiments will be described more fully hereinafter with reference to the accompanying drawings. Like reference numerals may refer to like elements throughout accompanying drawings.

It will be understood that the terms "first," "second," "third," etc. are used herein to distinguish one element from another, and the elements are not limited by these terms. Thus, a "first" element in an exemplary embodiment may be described as a "second" element in another exemplary embodiment.

It should be understood that descriptions of features or aspects within each exemplary embodiment should typically be considered as available for other similar features or aspects in other exemplary embodiments, unless the context clearly indicates otherwise.

As used herein, the singular forms "a", "an" and "the" are intended to include the plural forms as well, unless the context clearly indicates otherwise.

It will be understood that when a component is referred to as being "on", "connected to", "coupled to", or "adjacent to" another component, it can be directly on, connected, coupled, or adjacent to the other component, or intervening components may be present. It will also be understood that when a component is referred to as being "between" two components, it can be the only component between the two components, or one or more intervening components may also be present. Other words used to describe the relationship between components should be interpreted in a like fashion.

Herein, when one value is described as being about equal to another value or being substantially the same as or equal to another value, it is to be understood that the values are identical, the values are equal to each other within a measurement error, or if measurably unequal, are close enough in value to be functionally equal to each other as would be understood by a person having ordinary skill in the art. For example, the term "about" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" may mean within one or more standard deviations as understood by one of the ordinary skill in the art. Further, it is to be understood that while parameters may be described herein as having "about" a certain value, according to exemplary embodiments, the parameter may be exactly the certain value or approximately the certain value within a measurement error as would be understood by a person having ordinary skill in the art.

Herein, the phrase "an element A (or element B)" may indicate that elements A and B are different names that may be used to refer to the same element.

FIG. 1 is a diagram illustrating a display device in accordance with an exemplary embodiment of the present disclosure.

Referring to FIG. 1, the display device 100 may include a display 110 (or display panel), a scan driver 120 (or gate driver), a data driver 130 (or source driver), a timing controller 140, and an emission driver 150.

The display 110 may include scan lines SL1 to SLn (n is a positive integer) (or first gate lines), gate lines SSL1 to SSLn (or second gate lines), data lines DL1 to DLm (m is a positive integer), emission control lines EL1 to ELn, and pixels PXL. The pixels PXL may be arranged in areas (e.g., pixel areas) defined by the scan lines SL1 to SLn and the data lines DL1 to DLm.

The pixel PXL may be connected to at least one of the scan lines SL1 to SLn, at least one of the gate lines SSL1 to SSLn, one of the data lines DL1 to DLm, and one of the emission control lines EL1 to ELn. In exemplary embodiment of the present disclosure, the term "connection" may mean an electrical and/or physical connection. For example, a pixel PXL disposed on an ith pixel row and a jth pixel column may be connected to a scan line SLi, a next scan line SLi+1, a gate line SSLi, a previous gate line SSLi−k, a data line DLj, and an emission control line ELi (j is a positive integer, k is an integer of 3 or more, and i is an integer greater than k).

The pixel PXL may perform an initialization operation of performing initialization in response to a gate signal (or previous gate signal provided at a previous time) provided through the previous gate line SSLi−k, and perform a compensation operation of sampling or compensating for a threshold voltage of an internal transistor (e.g., a first transistor T1 to be described with reference to FIG. 2A) in response to a gate signal (or gate signal provided at a current time) provided through the gate line SSLi. In some exemplary embodiments, the pixel PXL may repeat the initialization operation and the compensation operation twice or more. Also, the pixel PXL may store or record a data signal provided through the data line DLj in response to a scan signal (or scan signal provided at the current time) provided through the scan line SLi, and initialize an anode electrode of a light emitting element in the pixel PXL in response to a next scan signal provided through the next scan line SLi+1. Further, the pixel PXL may emit light corresponding to the stored data signal in response to an emission control signal provided through the emission control line ELi. A detailed configuration and operation of the pixel PXL will be described later with reference to FIGS. 2A and 3A.

A first power voltage VDD, a second power voltage VSS, a reference voltage VREF, and an initialization voltage VINIT may be provided to the display 110. The first power voltage VDD, the second power voltage VSS, the reference voltage VREF, and the initialization voltage VINIT are voltages utilized for an operation of the pixel PXL, and may be provided to the display 110 from a separate power supply. The first power voltage VDD may have a voltage level higher than that of the second power voltage VSS. The reference voltage VREF may be a DC voltage having a voltage level equal to that of the first power voltage VDD or having a specific voltage level. The initialization voltage VINIT may have a voltage level lower than that of the data voltage.

The scan driver 120 may generate a gate signal and a scan signal, based on a scan control signal, sequentially provide the gate signal to the gate lines SSL1 to SSLn, and sequentially provide the scan signal to the scan lines SL1 to SLn.

In some exemplary embodiments, the scan driver 120 may include a first scan driver 121 (or first gate driver) and a second scan driver 122 (or second gate driver).

The first scan driver 121 may generate a gate signal, based on a first scan control signal SCS1 (or first gate control signal), and sequentially provide the gate signal to the gate lines SSL1 to SSLn. The first scan control signal SCS1 may include a first scan start signal (or first gate start signal), first scan clock signals (or first gate clock signal), etc., and be provided from the timing controller 140. For example, the first scan driver 121 may include a shift register (or stage) which sequentially generates and outputs gate signals in a pulse form, which corresponds to the first scan start signal in a pulse form, by using the first scan clock signals.

Similar to the first scan driver 121, the second scan driver 122 may generate a scan signal, based on a second scan control signal SCS2 (or second gate control signal), and sequentially provide the scan signal to the scan lines SL1 to SLn. The second scan control signal SCS2 may include a second scan start signal (or second gate start signal), second scan clock signals (or second gate clock signals), etc., and be provided from the timing controller 140. For example, the second scan driver 122 may include a shift register which sequentially generates and outputs gate signals in a pulse form, which corresponds to the second scan start signal in a pulse form, by using the second scan clock signals.

The data driver 130 may generate data signals, based on image data DATA2 and a data control signal DCS, which are provided from the timing controller 140, and provide the data signals to the display 110 (e.g., to the pixels PXL of the display 110). The data control signal DCS is a signal for controlling an operation of the data driver 130, and may include a load signal (or data enable signal) instructing an output of a valid data signal, a vertical synchronization signal, a horizontal synchronization signal, etc.

The timing controller 140 may receive input image data DATA1 and a control signal CS from a source outside of the display device 100 (e.g., from a graphic processor), generate the scan control signal (or the first scan control signal SCS1 and the second scan control signal SCS2) and the data control signal DCS, and generate the image data DATA2 by converting the input image data DATA1. For example, the timing controller 140 may convert the input image data DATA1 in an RGB format into the image data DATA2 in an RGBG format, which corresponds to a pixel arrangement in the display 110.

The emission driver 150 may generate an emission control signal, based on an emission driving control signal ECS, and sequentially provide the emission control signal to the emission control lines EL1 to ELn. The emission driving control signal ECS may include an emission start signal, emission clock signals, etc., and be provided from the timing controller 140. For example, the emission driver 150 may include a shift register, which sequentially generates and outputs an emission control signal in a pulse form, which corresponds to the emission start signal in a pulse form, by using the emission clock signals.

At least one of the scan driver 120, the data driver 130, the timing controller 140, and the emission driver 150 may be formed in the display 110, or be implemented as an integrated circuit (IC) to be connected to the display 110 through a flexible circuit board. In addition, at least two of the scan driver 120, the data driver 130, the timing controller 140, and the emission driver 150 may be implemented as an IC.

Figure 2A:
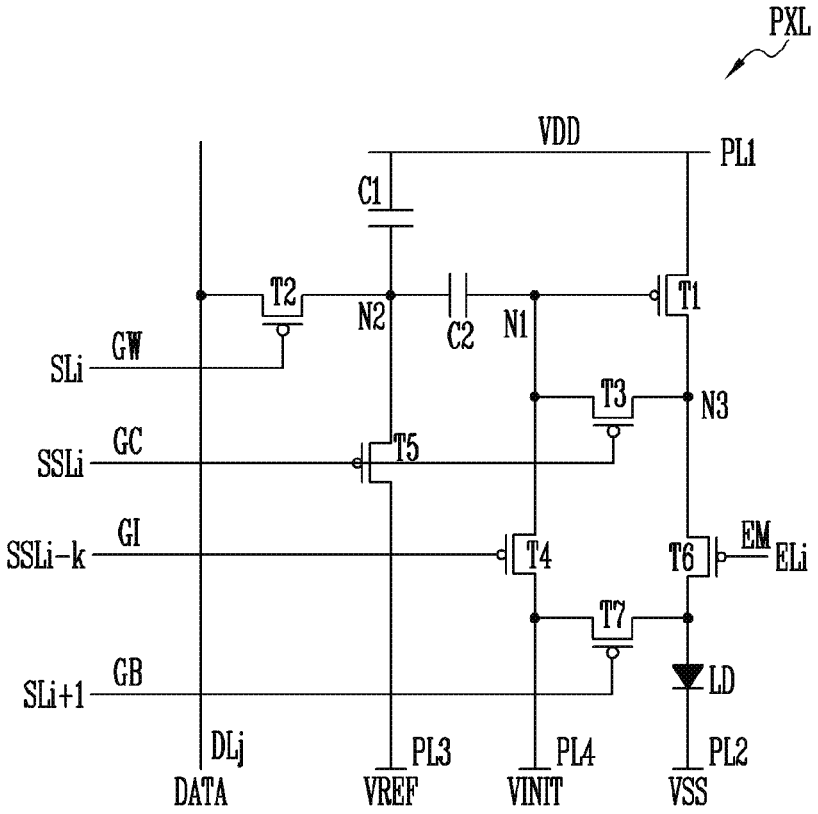
FIG. 2A is a circuit diagram illustrating an example of a pixel included in the display device shown in FIG. 1.
Figure 2B:
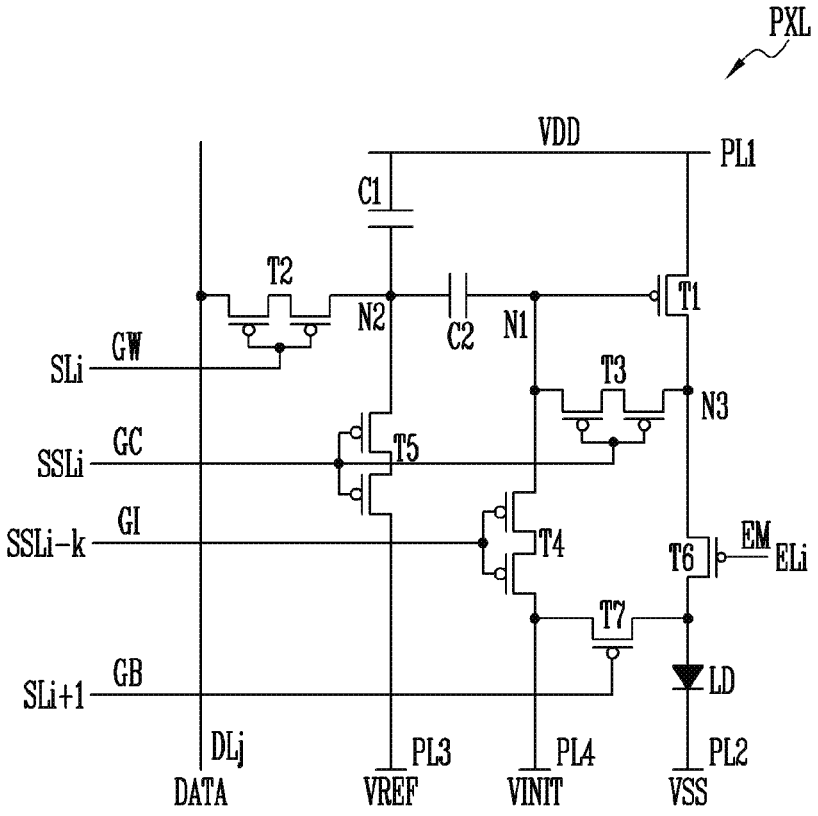
FIG. 2B is a circuit diagram illustrating another example of a pixel included in the display device shown in FIG. 1.

FIG. 2A is a circuit diagram illustrating an example of a pixel included in the display device shown in FIG. 1. FIG. 2B is a circuit diagram illustrating another example of a pixel included in the display device shown in FIG. 1. In FIGS. 2A and 2B, a pixel PXL located on an ith pixel row and a jth pixel column is illustrated as an example.

First, referring to FIG. 2A, the pixel PXL may include a light emitting element LD and a pixel circuit (or pixel driving circuit) for controlling an amount of current flowing through the light emitting element LD.

The light emitting element LD is connected between a first power voltage VDD (or first power source) and a second power voltage VSS (or second power source).

For example, an anode electrode of the light emitting element LD is connected to a first power line PL1 (e.g., the first power line PL1 to which the first power voltage VDD is applied) via the pixel circuit, and a cathode electrode of the light emitting element LD may be connected to a second power line PL2 (e.g., the second power line PL2 to which the second power voltage VSS is applied). The light emitting element LD may emit light with a luminance corresponding to a driving current provided from the pixel circuit.

The first power voltage VDD and the second power voltage VSS have a potential difference which allows the light emitting element LD to emit light. For example, the first power voltage VDD may be a high-potential pixel power source, and the second power voltage VSS may be a low-potential pixel power source having a potential lower by a threshold voltage of the light emitting element LD than that of the first power voltage VDD.

The light emitting element LD may be an organic light emitting diode (OLED) including an organic light emitting layer, but the present disclosure is not limited thereto. For example, the light emitting element LD may include micro inorganic light emitting diodes small to a degree of nano scales to micro scales.

The pixel circuit may include at least one transistor and at least one capacitor. For example, the pixel circuit may include a first transistor T1 (or driving transistor), a second transistor T2, a third transistor T3, a fourth transistor T4, a fifth transistor T5, a sixth transistor T6 (or emission transistor), a seventh transistor T7 (or initialization transistor), a first capacitor C1 (or storage capacitor), and a second capacitor C2. Each of the first transistor T1, the second transistor T2, the third transistor T3, the fourth transistor T4, the fifth transistor T5, the sixth transistor T6, and the seventh transistor T7 may be implemented with a P-type transistor (e.g., a P-type MOSFET). However, the present disclosure is not limited thereto, and at least one transistor may be implemented with an N-type transistor.

The first transistor T1 may include a first electrode connected to the first power line PL1, a second electrode connected to a third node N3, and a gate electrode connected to a first node N1. The first power voltage VDD may be applied to the first power line PL1. The first transistor T1 may control an amount of driving current flowing through the light emitting element LD, in response to a source-gate voltage (e.g., a voltage between the first electrode and the gate electrode).

The first capacitor C1 may be connected or formed between the first power line PL1 and a second node N2. The first capacitor C1 may store a voltage of the second node N2, and stabilize the voltage of the second node N2. The second capacitor C2 may be connected between the first node N1 and the second node N2. The second capacitor C2 may store a voltage provided to the first node N1 and the second node N2.

The second transistor T2 may include a first electrode connected to a data line DLj, a second electrode connected to the second node N2, and a gate electrode connected to a scan line SLi. The scan line SLi may also be referred to as a first scan line SLi. The second transistor T2 may be turned on in response to a scan signal GW provided through the scan line SLi and having a gate-on voltage level (e.g., a turn-on voltage level, which may be a logic low level), and provide the second node N2 with a data voltage DATA (e.g., a data voltage applied to the data line DLj or a data signal). Since the first transistor T1 is a P-type transistor, the voltage level of the data voltage DATA may become lower as a grayscale to be expressed becomes higher.

The third transistor T3 may include a first electrode connected to the first node N1, a second electrode connected to the third node N3, and a gate electrode connected to a gate line SSLi. The gate line SSLi may be referred to as a first gate line SSLi. The third transistor T3 may be turned on in response to a compensation control signal GC having a gate-on voltage level (or a gate signal provided through the gate line SSLi), and connect the first node N1 and the third node N3. That is, the first transistor T1 may be turned on in a diode connection form by the third transistor T3. A voltage corresponding to a difference between the first power voltage VDD and a threshold voltage of the first transistor T1 may be sampled at the first node N1.

The fourth transistor T4 may include a first electrode connected to the first node N1, a second electrode connected to a fourth power line PL4 (or an initialization power line), and a gate electrode connected to a previous gate line SSLi−k. The previous gate line SSLi−k may also be referred to as a second gate line SSLi−k. An initialization voltage VINIT may be applied to the fourth power line PL4. The fourth transistor T4 may be turned on in response to a first initialization control signal GI having a gate-on voltage level (or a previous gate signal provided through the previous gate line SSLi−k), and provide the initialization voltage VINIT to the first node N1. The initialization voltage VINIT may be set lower than the data voltage DATA. For example, the initialization voltage VINIT may be set lower than the lowest voltage of the data voltage DATA. That is, the fourth transistor T4 may initialize the first node N1 to the initialization voltage VINIT.

The fifth transistor T5 may include a first electrode connected to the second node N2, a second electrode connected to a third power line PL3 (or a reference power line), and a gate electrode connected to the gate line SSLi. A reference voltage VREF may be applied to the third power line PL3. The fifth transistor T5 may be turned on in response to a compensation control signal GC having a gate-on voltage level (or a gate signal provided through the gate line SSLi), and provide the reference voltage VREF to the second node N2. The reference voltage VREF may be equal to the first power voltage VDD or be a DC voltage having a specific voltage level. That is, the fifth transistor T5 may initialize the second node N2 to the reference voltage VREF.

The sixth transistor T6 may include a first electrode connected to the third node N3, a second electrode connected to the anode electrode of the light emitting element LD, and a gate electrode connected to an emission control line ELi. The sixth transistor T6 may be turned on in response to an emission control signal EM having a gate-on voltage level (e.g., the emission control signal EM provided through the emission control line ELi), and form a current flow path between the third node N3 and the light emitting element LD. That is, when the sixth transistor T6 is turned on, a driving current may be provided to the light emitting element LD, and the light emitting element LD may emit light with a luminance corresponding to the driving current. On the contrary, when the sixth transistor T6 is turned off, the current flow path of the driving current may be interrupted, and the light emitting element LD may not emit light.

The seventh transistor T7 may include a first electrode connected to the fourth power line PL4, a second electrode connected to the anode electrode of the light emitting element LD, and a gate electrode connected to a next scan line SLi+1. The seventh transistor T7 may be turned on in response to a second initialization control signal GB having a gate-on voltage level (e.g., a bypass control signal or next scan signal provided through the next scan line SLi+1), and provide the initialization voltage VINIT (e.g., the initialization voltage VINIT applied to the fourth power line PL4) to the anode electrode of the light emitting diode LD. Electric charges charged in a parasitic capacitor formed in the light emitting element LD (e.g., a parasitic capacitor generated due to a structure of the light emitting element LD) may be initialized by the initialization voltage VINIT. Although a case in which the gate electrode of the seventh transistor T7 is connected to the next scan line SLi+1 is illustrated in FIG. 2A, the present disclosure is not limited thereto. For example, the gate electrode of the seventh transistor T7 may be connected to a control line formed separately from the next scan line SLi+1, and the second initialization control signal GB may be applied to the control line. When the seventh transistor T7 transfers the initialization voltage VINIT to the anode electrode of the light emitting element LD before an emission period in which the light emitting element LD emits light, the pixel PXL may exhibit a more uniform luminance characteristic with respect to the data voltage DATA.

In an exemplary embodiment, the first transistor T1, the second transistor T2, the third transistor T3, the fourth transistor T4, the fifth transistor T5, the sixth transistor T6, and the seventh transistor T7 may be formed as transistors having similar structures and similar sizes. In an exemplary embodiment, at least one of the first transistor T1, the second transistor T2, the third transistor T3, the fourth transistor T4, the fifth transistor T5, the sixth transistor T6, and the seventh transistor T7 may be formed as a transistor having a structure and a size which are different from those of the other transistors.

In an exemplary embodiment, at least one of the second transistor T2, the third transistor T3, the fourth transistor T4, and the fifth transistor T5 may be implemented as a dual gate transistor (or a transistor including a plurality of sub-transistors connected in series). For example, as shown in FIG. 2B, in an exemplary embodiment, each of the second transistor T2, the third transistor T3, the fourth transistor T4, and the fifth transistor T5 may be implemented as a dual gate transistor, and include two sub-transistors connected in series. In a state in which each of the third transistor T3 and the fourth transistor T4 is turned off, a leakage current flowing through the third transistor T3 and the fourth transistor T4 may be reduced. In addition, a leakage current flowing through the second transistor T2 and the fifth transistor T5 may be reduced, and voltage fluctuation of each of the second node N2 and the first node N1 (e.g., the first node N1 capacitor-coupled to the second node N2) may be reduced. Referring to FIG. 2B, a further description of elements and technical aspects previously described with reference to FIG. 2A have been omitted for convenience of explanation.

Figure 3A:
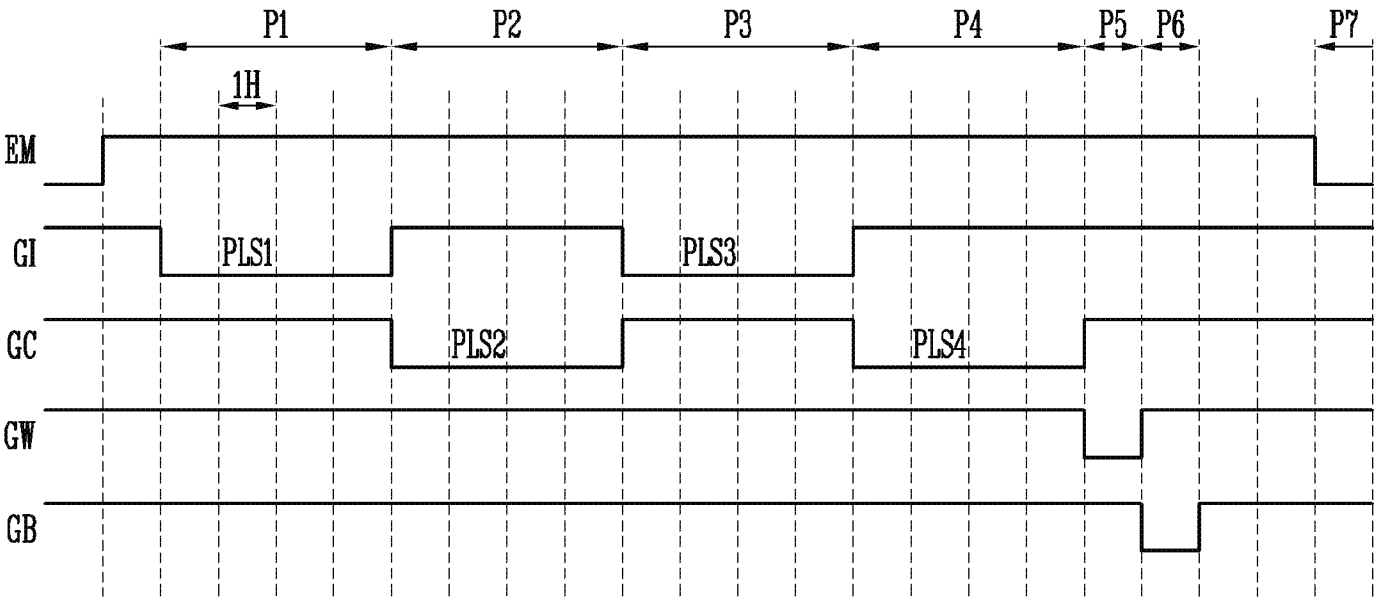
FIG. 3A is a waveform diagram illustrating an example of signals provided to the pixel shown in FIG. 2A.
Figure 3B:
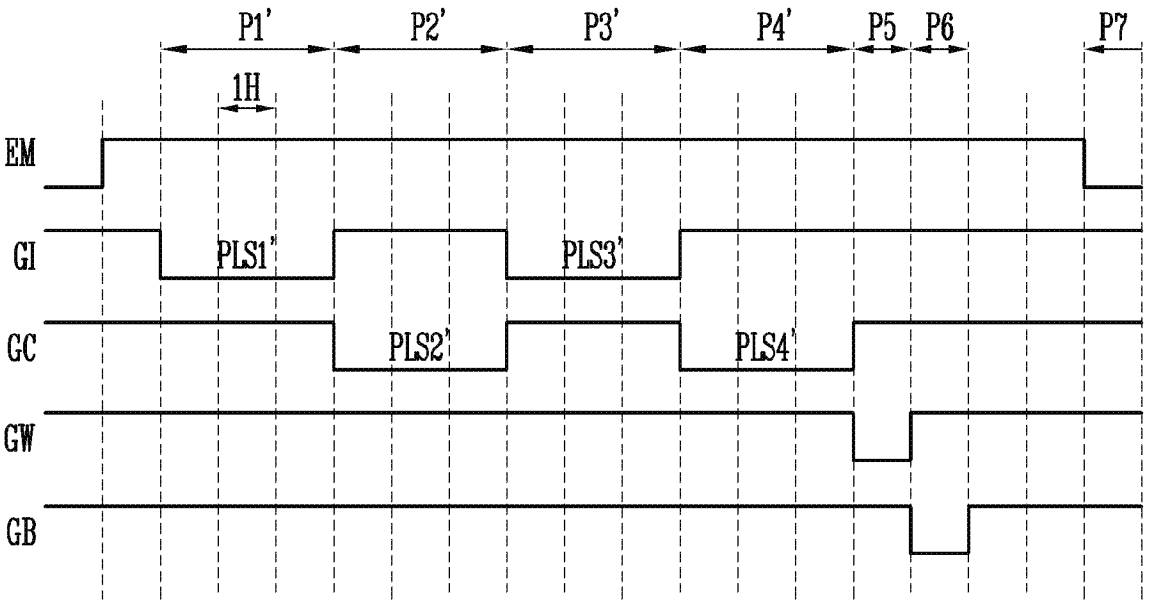
FIG. 3B is a waveform diagram illustrating an example of the signals provided to the pixel shown in FIG. 2A.

FIG. 3A is a waveform diagram illustrating an example of signals provided to the pixel shown in FIG. 2A. FIG. 3B is a waveform diagram illustrating an example of the signals provided to the pixel shown in FIG. 2A. FIGS. 4A, 4B, 4C, 4D, 4E, and 4F are circuit diagrams illustrating operations of the pixel shown in FIG. 2A. For example, sequential operations of the pixel shown in FIG. 2A according to the signals shown in FIG. 3A are illustrated in FIGS. 4A, 4B, 4C, 4D, 4E, and 4F.

First, referring to FIGS. 2A and 3A, the emission control signal EM, the first initialization control signal GI, the compensation control signal GC, the scan signal GW, and the second initialization control signal GB are illustrated in FIG. 3A. Herein, signals applied to the gate lines including, for example, the first initialization control signal GI and the compensation control signal GC, may be referred to as gate signals, and signals applied to the scan lines including, for example, the scan signal GW and the second initialization control signal GB, may be referred to as scan signals. As described with reference to FIG. 2A, the emission control signal EM may be provided through the emission control line ELi, the first initialization control signal GI may be provided through the previous gate line SSLi−k, the compensation control signal GC may be provided through the gate line SSLi, the scan signal GW may be provided through the scan line SLi, and the second initialization control signal GB may be provided through the next scan line SLi+1 or a separate control line.

A period (e.g., a non-emission period of the pixel PXL) in which the emission control signal EM has a gate-off voltage level (e.g., a turn-off voltage level, which may be a logic high level) may include a first period P1, a second period P2, a third period P3, a fourth period P4, a fifth period P5 (or scan period), and a sixth period P6. The first period P1, the second period P2, the third period P3, the fourth period P4, the fifth period P5, and the sixth period P6 do not overlap one another in the non-emission period. In addition, a period (e.g., an emission period of the pixel PXL) in which the emission control signal EM has a gate-on voltage level (e.g., a turn-on voltage level, which may be a logic low level) may include a seventh period P7. The first period P1, the second period P2, the third period P3, the fourth period P4, the fifth period P5, the sixth period P6, and the seventh period P7 may be included in one frame (or one frame period).

During the first period P1, the first initialization control signal GI may have a gate-on voltage level. That is, the first initialization control signal GI may have a first pulse PLS1 of the gate-on voltage level in the first period P1. Herein, a gate-on voltage level may correspond to a logic low level, and a gate-off voltage level may correspond to a logic high level. However, the present disclosure is not limited thereto. A pulse width of the first pulse PLS1 is greater than three horizontal time intervals (e.g., 3×1 horizontal time intervals (1H)). For example, the pulse width of the first pulse PLS1 (and a width of the first period P1) may be four horizontal time intervals. One horizontal time interval is an amount of time allocated to apply a data voltage to one pixel row. For example, when the display device 100 (see FIG. 1) reproduces an image at a frequency of 240 Hz, the one horizontal time interval may be about 1.84 μs or less. The previous gate line SSLi−k to which the first initialization control signal GI is applied may be a gate line prior to three lines (or three pixel rows) from the gate line SSLi (e.g., k=3). In another example, as shown in FIG. 3B, a pulse width of a first pulse PLS1' (and a width of a first period P1') may be three horizontal time intervals. The previous gate line SSLi−k to which the first initialization control signal GI is applied may be a gate line prior to four lines (or four pixel rows) from the gate line SSLi (e.g., k=4).

Each of the compensation control signal GC, the scan signal GW, and the second initialization control signal GB may have a gate-off voltage level.

Figure 4A:
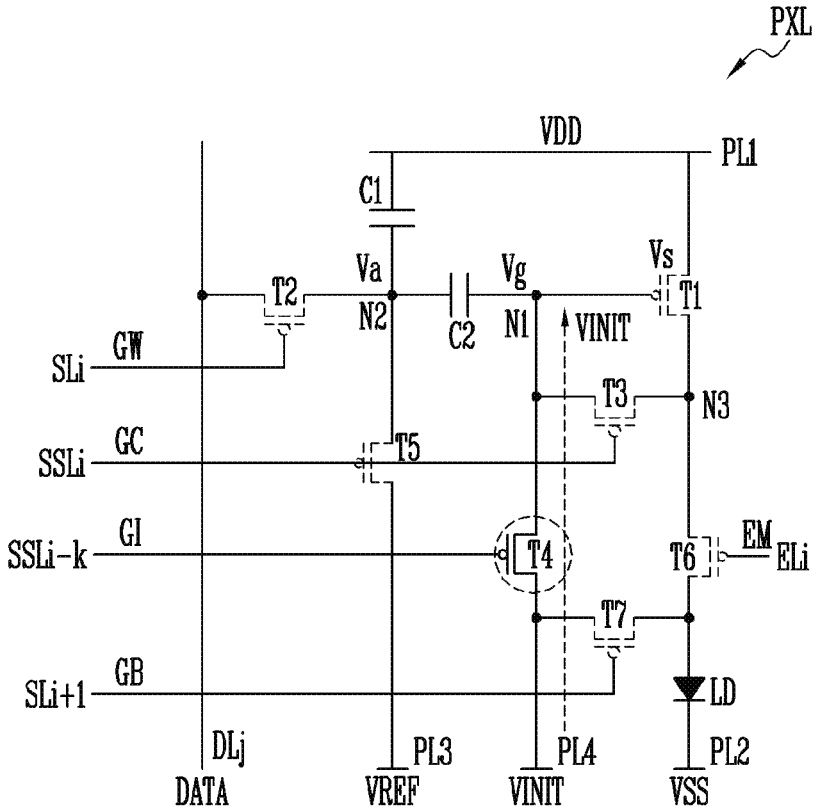
FIGS. 4A, 4B, 4C, 4D, 4E, and 4F are circuit diagrams illustrating operations of the pixel shown in FIG. 2A.

Referring to FIG. 4A, the fourth transistor T4 may be turned on in response to the first initialization control signal GI (or the first pulse PLS1) having the gate-on voltage level, and the initialization voltage VINIT may be primarily provided to the first node N1. That is, the first node N1 may be initialized to the initialization voltage VINIT, and a voltage Vg (or a voltage of the gate electrode of the first transistor T1) may become equal to the initialization voltage VINIT.

Herein, when a voltage is described as being primarily provided (or applied) to a node, secondarily provided (or applied) to the node, tertiarily provided (or applied) to the node, etc., the voltage may be provided (or applied) to the node at different times. For example, the voltage may be primarily provided (or applied) to the node at a first time point, the voltage may be secondarily provided (or applied) to the node at a second time point subsequent to the first time point, may be tertiarily provided (or applied) to the node at a third time point subsequent to the second time point, etc.

Since the first electrode (or source electrode) of the first transistor T1 is connected to the first power line PL1, a voltage Vs of the source electrode of the first transistor T1 may be equal to the first power voltage VDD.

Meanwhile, a voltage Va of the second node N2 may have a previous data voltage (e.g., a data voltage of a previous frame) due to the first capacitor C1.

That is, the first node N1 (or the gate electrode of the first transistor T1) may be initialized by the initialization voltage VINIT in the first period P1.

Referring back to FIG. 3A, during the second period P2, the compensation control signal GC may have a gate-on voltage level. That is, the compensation control signal GC may have a second pulse PLS2 of the gate-on voltage level in the second period P2. The compensation control signal GC may have a waveform in which the first initialization control signal GI is shifted by the first period P1 (e.g., four or three horizontal time intervals). Therefore, like the pulse width of the first pulse PLS1, a pulse width of the second pulse PLS2 is greater than three horizontal time intervals. For example, the pulse width of the second pulse PLS2 (and a width of the second period P2) may be four horizontal time intervals. In another example, as shown in FIG. 3B, a pulse width of a second pulse PLS2' (and a width of a second period P2') may be three horizontal time intervals.

Meanwhile, each of the first initialization control signal GI, the scan signal GW, and the second initialization control signal GB may have a gate-off voltage level.

Figure 4B:
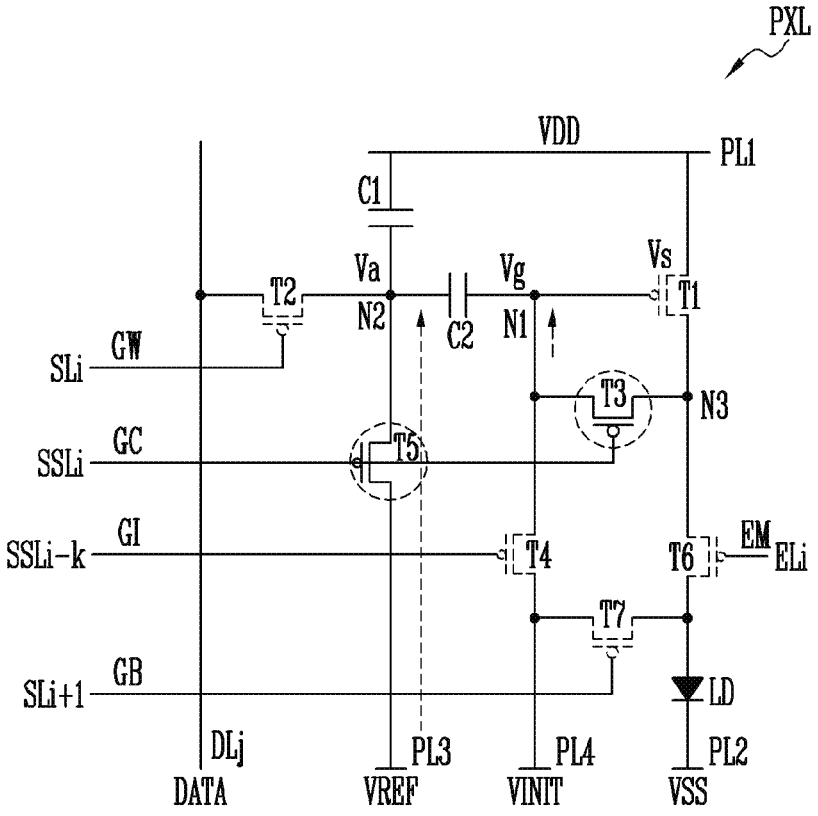

Referring to FIG. 4B, the fifth transistor T5 may be turned on in response to the compensation control signal GC (or the second pulse PLS2) having the gate-on voltage level, and the reference voltage VREF may be primarily provided to the second node N2. That is, the second node N2 may be initialized to the reference voltage VREF, and the voltage Va of the second node N2 may be changed to be equal to the reference voltage VREF.

In addition, the third transistor T3 may be turned on in response to the compensation control signal GC (or the second pulse PLS2) having the gate-on voltage level, and the gate electrode and the drain electrode (or second electrode) of the first transistor T1 may be connected to each other. That is, the first transistor T1 may be diode-connected. A voltage corresponding to a difference (or voltage difference) between the first power voltage VDD and the threshold voltage of the first transistor T1 may be sampled at the first node N1. The voltage Vg of the first node N1 is similar to the voltage corresponding to the difference between the first power voltage VDD and the threshold voltage of the first transistor T1, but may be different from the difference between the first power voltage VDD and the threshold voltage of the first transistor T1. For example, the voltage Vg of the first node N1, for example, in the second period P2, may be expressed as "VDD−Vth+a." Vth may be the threshold voltage of the first transistor T1, and a may be a component of the previous data voltage of a previous frame caused by capacitor coupling of the second capacitor C2.

Since the voltage Va of the second node N2 is changed to the reference voltage VREF from the previous data voltage, a variation of the voltage Va of the second node N2 may be transferred to the first node N1 through the capacitor coupling of the second capacitor C2. Therefore, unlike an ideal sampling voltage (e.g., "VDD−Vth"), the voltage Vg of the first node N1 may further include the component of the previous data voltage (e.g., the variation of the voltage Va of the second node N2).

When the compensation control signal GC has three horizontal time intervals or more (e.g., about 3.2 μs or more), the threshold voltage of the first transistor T1 is more accurately sampled. Thus, the threshold voltage of the first transistor T1 can be accurately reflected to the data voltage DATA.

Referring back to FIG. 3A, during the third period P3, the first initialization control signal GI may have a gate-on voltage level. That is, the first initialization control signal GI may have a third pulse PLS3 having the gate-on voltage level in the third period P3. A pulse width of the third pulse PLS3 (or a width of the third period P3) may be equal to the pulse width of the first pulse PLS1 (or the width of the first period P1). For example, the pulse width of the third pulse PLS3 (and a width of the third period P3) may be four horizontal time intervals. In another example, as shown in FIG. 3B, a pulse width of a third pulse PLS3' (and a width of a third period P3') may be three horizontal time intervals.

Each of the compensation control signal GC, the scan signal GW, and the second initialization control signal GB may have a gate-off voltage level.

Figure 4C:
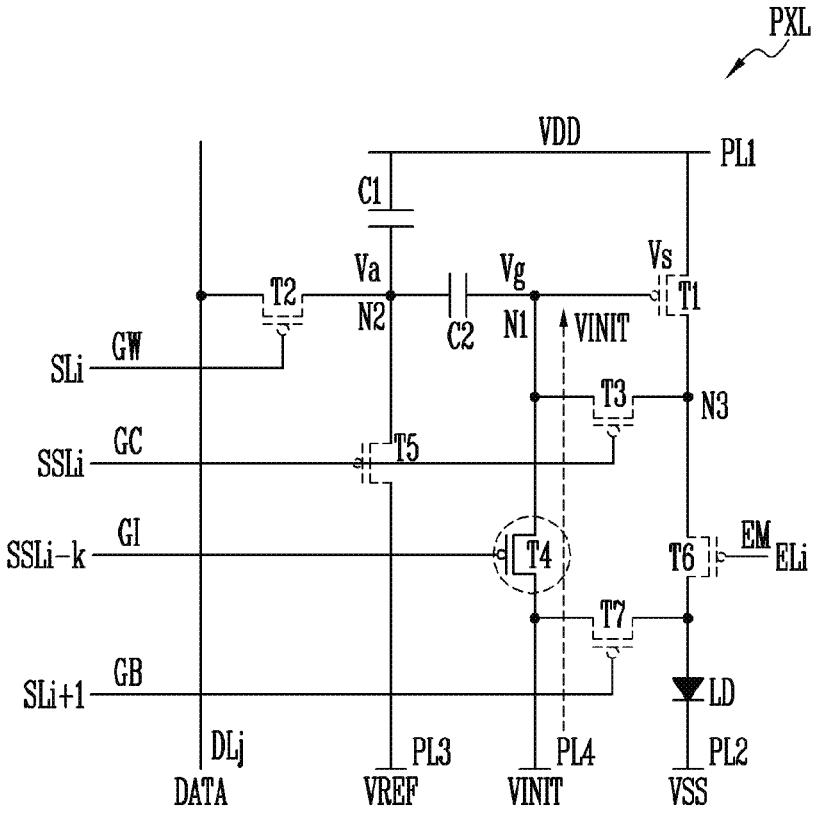

Referring to FIG. 4C, similar to the operation of the pixel PXL, which is described with reference to FIG. 4A, the fourth transistor T4 may be turned on in response to the first initialization control signal GI (or the third pulse PLS3) having the gate-on voltage level, and the initialization voltage VINIT may be secondarily provided to the first node N1. That is, the first node N1 (or the gate electrode of the first transistor T1) may be initialized by the initialization voltage VINIT in the third period P3.

Meanwhile, the voltage Va of the second node N2 may be maintained equal to the reference voltage VREF as a result of the reference voltage VREF being applied in the second period P2.

Referring back to FIG. 3A, during the fourth period P4, the compensation control signal GC may have a gate-on voltage level. That is, the compensation control signal GC may have a fourth pulse PLS4 having the gate-on voltage level in the fourth period P4. A pulse width of the fourth pulse PLS4 (or a width of the fourth period P4) may be equal to the pulse width of the second pulse PLS2 (or the width of the second period P2). For example, the pulse width of the fourth pulse PLS4 (and a width of the fourth period P4) may be four horizontal time intervals. In another example, as shown in FIG. 3B, a pulse width of a fourth pulse PLS4' (and a width of a fourth period P4') may be three horizontal time intervals.

Each of the first initialization control signal GI, the scan signal GW, and the second initialization control signal GB may have a gate-off voltage level.

Figure 4D:
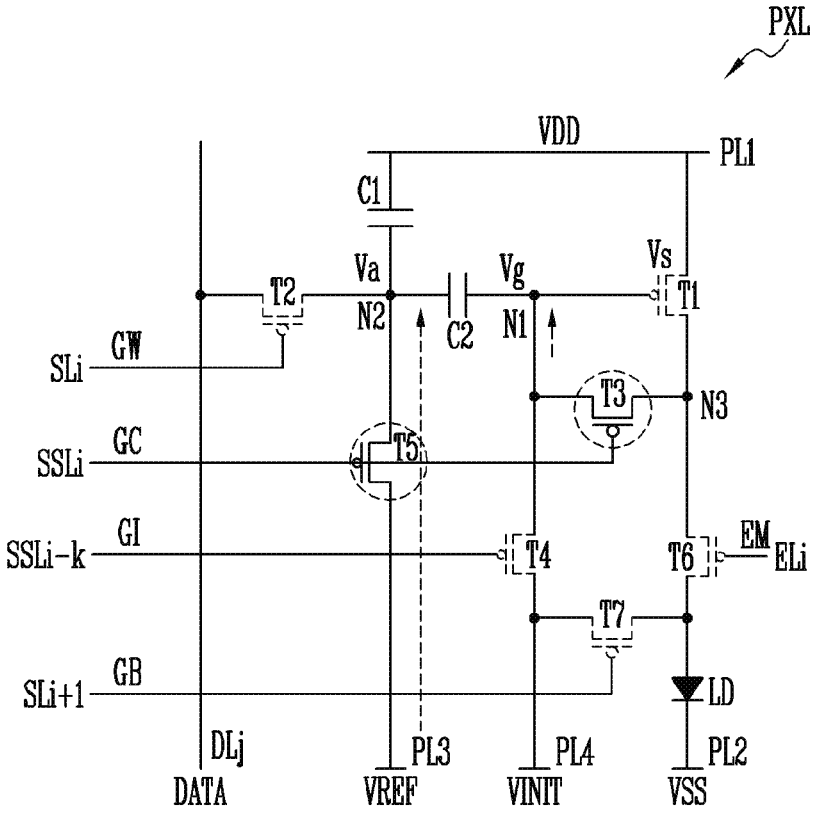

Referring to FIG. 4D, similar to the operation of the pixel PXL described with reference to FIG. 4B, the fifth transistor T5 may be turned on in response to the compensation control signal GC (or the fourth pulse PLS4) having the gate-on voltage level, and the reference voltage VREF may be secondarily provided to the second node N2. In addition, the third transistor T3 may be turned on in response to the compensation control signal GC (or the fourth pulse PLS4) having the gate-on voltage level, and the gate electrode and the drain electrode (or second electrode) of the first transistor T1 may be connected to each other. That is, the first transistor T1 may be diode-connected.

A voltage corresponding to a difference (or voltage difference) between the first power voltage VDD and the threshold voltage of the first transistor T1 may be sampled at the first node N1. The voltage Vg of the first node N1, for example, in the fourth period P4, may be substantially equal to the difference between the first power voltage VDD and the threshold voltage of the first transistor T1.

Since the voltage Va of the second node N2 is in a state in which the voltage Va of the second node N2 is maintained as the reference voltage VREF, the component of the previous data voltage may be removed from the voltage Vg of the first node N1. Thus, the voltage Vg of the first node N1 can be normally compensated.

Referring back to FIG. 3A, during the fifth period P5, the scan signal GW may have a gate-on voltage level. That is, the scan signal GW may have a pulse of the gate-on voltage level in the fifth period P5. A width of the pulse of the scan signal GW (or a width of the fifth period P5) may be one horizontal time interval. Since the width of the pulse of the scan signal GW is the one horizontal time interval, the display device 100 (see FIG. 1) may have a higher resolution or operate at a higher driving frequency, without any structural change (e.g., without the addition of any data line).

Each of the first initialization control signal GI, the compensation control signal GC, and the second initialization control signal GB may have a gate-off voltage level.

Figure 4E:
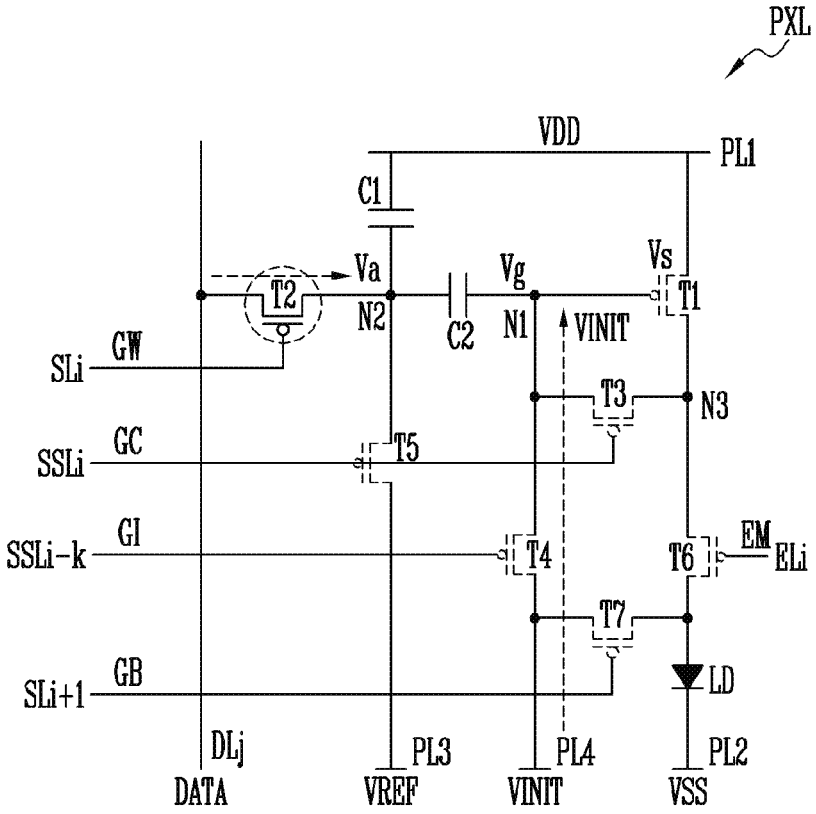

Referring to FIG. 4E, the second transistor T2 may be turned on in response to the scan signal GW having the gate-on voltage level, and the data voltage DATA may be provided to the second node N2. The voltage Va of the second node N2 may be changed to the data voltage DATA.

Since the first node N1 is connected to the second node N2 by the second capacitor C2, a variation of the voltage Va of the second node N2 (e.g., "DATA−VREF") may be reflected to the first node N1. Therefore, the voltage Vg of the first node N1 may be changed to "VDD−Vth+(DATA−VREF)."

The data voltage DATA is written to the pixel PXL in the fifth period P5 separately allocated just before the emission period, so that an instant afterimage can be minimized or reduced. The instant afterimage may be a phenomenon in which, when pixels (or different display areas including the pixels) are driven with different grayscales in a previous frame, the pixels emit lights with different luminances during a certain time even when the pixels are driven at the same grayscale in a next frame. The instant afterimage will be described later with reference to FIGS. 5A and 5B.

Thus, as can be seen in FIGS. 2A and 3A, in an exemplary embodiment, the scan driver 120 may provide a gate signal (e.g., the first initialization control signal GI) having the gate-on voltage level to the second gate line SSLi−k in the first period P1 and the third period P3, may provide a gate signal (e.g., the compensation control signal GC) having the gate-on voltage level to the first gate line SSLi in the second period P2 and the fourth period P4, and may provide the scan signal GW having the gate-on voltage level to the first scan line SLi in the fifth period P5 (e.g., in the scan period). The first period P1, the second period P2, the third period P3, and the fourth period P4 are sequentially located in one frame.

Referring back to FIG. 3A, during the sixth period P6, the second initialization control signal GB may have a gate-on voltage level. That is, the second initialization control signal GB may have a pulse having the gate-on voltage level in the sixth period P6. The second initialization control signal GB may have a waveform in which the scan signal GW is shifted by the fifth period P5 (e.g., one horizontal time interval). Therefore, like the width of the pulse of the scan signal GW (or the width of the fifth period P5), a width of the pulse of the second initialization control signal GB (or a width of the sixth period P6) may be one horizontal time interval.

Each of the first initialization control signal GI, the compensation control signal GC, and the scan signal GW may have a gate-off voltage level.

Figure 4F:
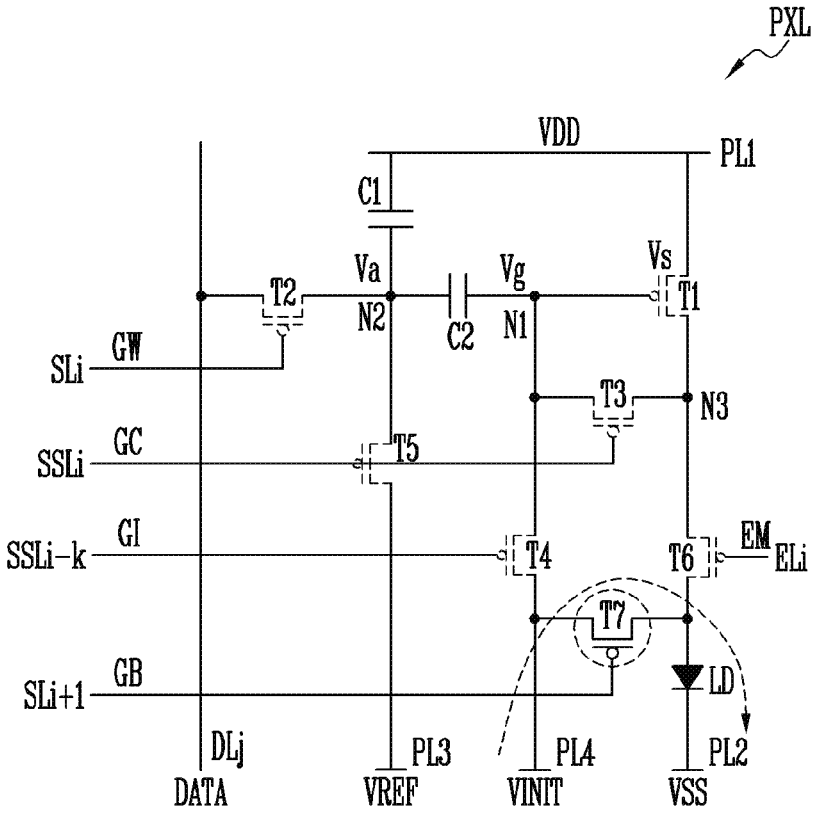

Referring to FIG. 4F, the seventh transistor T7 may be turned on in response to the second initialization control signal GB having the gate-on voltage level, and the initialization voltage VINIT may be provided to the anode electrode of the light emitting element LD. Electric charges charged in the parasitic capacitor formed in the light emitting element LD (e.g., the parasitic capacitor generated due to the structure of the light emitting element LD) may be initialized by the initialization voltage VINIT, and the pixel PXL may exhibit a more uniform luminance characteristic.

Referring back to FIG. 3A, during the seventh period P7, the emission control signal EM may have a gate-on voltage level, and each of the first initialization control signal GI, the compensation control signal GC, the scan signal GW, and the second initialization control signal GB may have a gate-off voltage level.

The sixth transistor T6 may be turned on in response to the emission control signal EM, and form a current flow path between the third node N3 and the light emitting element LD. A driving current may be provided to the light emitting element LD, and the light emitting element LD may emit light with a luminance corresponding to the driving current.

As described with reference to FIGS. 3A, 3B, 4A, 4B, 4C, 4D, 4E, and 4F, in one frame (or one continuous non-emission period), each of the first initialization control signal GI and the compensation control signal GC may include two pulses having a gate-on voltage level, and a width of each of the pulses may be three horizontal time intervals. Thus, since the width of the pulses of the compensation control signal GC is set to about 3.2 μs or more, the threshold voltage of the first transistor T1 can be accurately sampled.

In addition, the first node N1 (or the gate electrode of the first transistor T1) and the second node N2 may be sequentially initialized twice by the two pulses of each of the first initialization control signal GI and the compensation control signal GC. Thus, a component (or influence) of the previous data voltage is removed from the voltage Vg of the first node N1, and the threshold voltage of the first transistor T1 can be more accurately compensated by the voltage Vg of the first node N1 (or the voltage of the gate electrode of the first transistor T1).

Further, since the width of the pulse (e.g., the pulse having the gate-on voltage level) of the scan signal GW is one horizontal time interval (e.g., since the width of the pulse of the scan signal GW is set different from that of the compensation control signal GC, which has four horizontal time intervals (see FIG. 3A) or three horizontal time intervals (see FIG. 3B)), the instant afterimage can be minimized or reduced.

Although a case in which each of the first initialization control signal GI and the compensation control signal GC includes two pulses having a gate-on voltage level is illustrated in FIGS. 3A and 3B, the first initialization control signal GI and the compensation control signal GC are not limited thereto. For example, each of the first initialization control signal GI and the compensation control signal GC may include three pulses having a gate-on voltage level.

As shown in FIGS. 3A and 3B, according to exemplary embodiments, the width of each of the first to fourth periods P1 to P4 may be three or more times the width of the fifth period P5 (e.g., the scan period), and the width of the fifth period P5 (e.g., the scan period) may be one horizontal time period 1H.

Figure 5A:
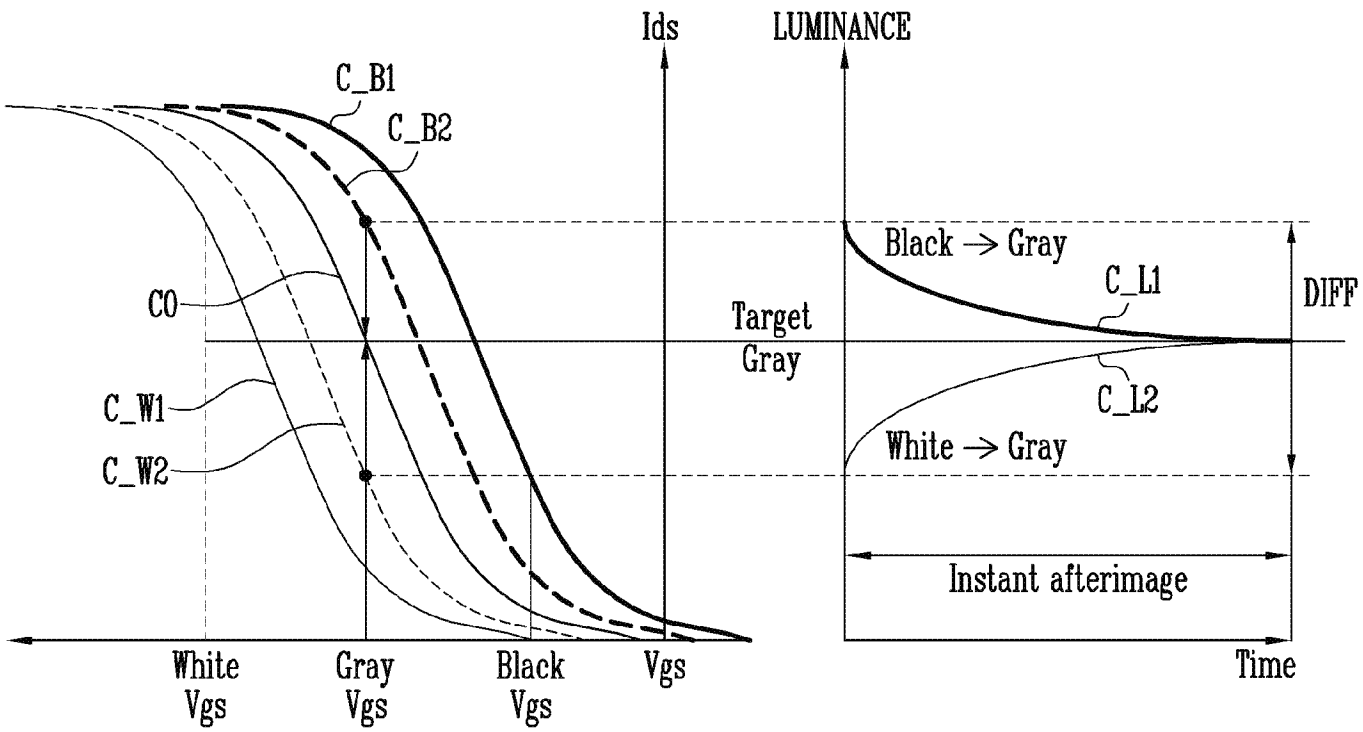
FIG. 5A is a graph illustrating a comparative example of a characteristic of a first transistor included in the pixel shown in FIG. 2A.
Figure 5B:
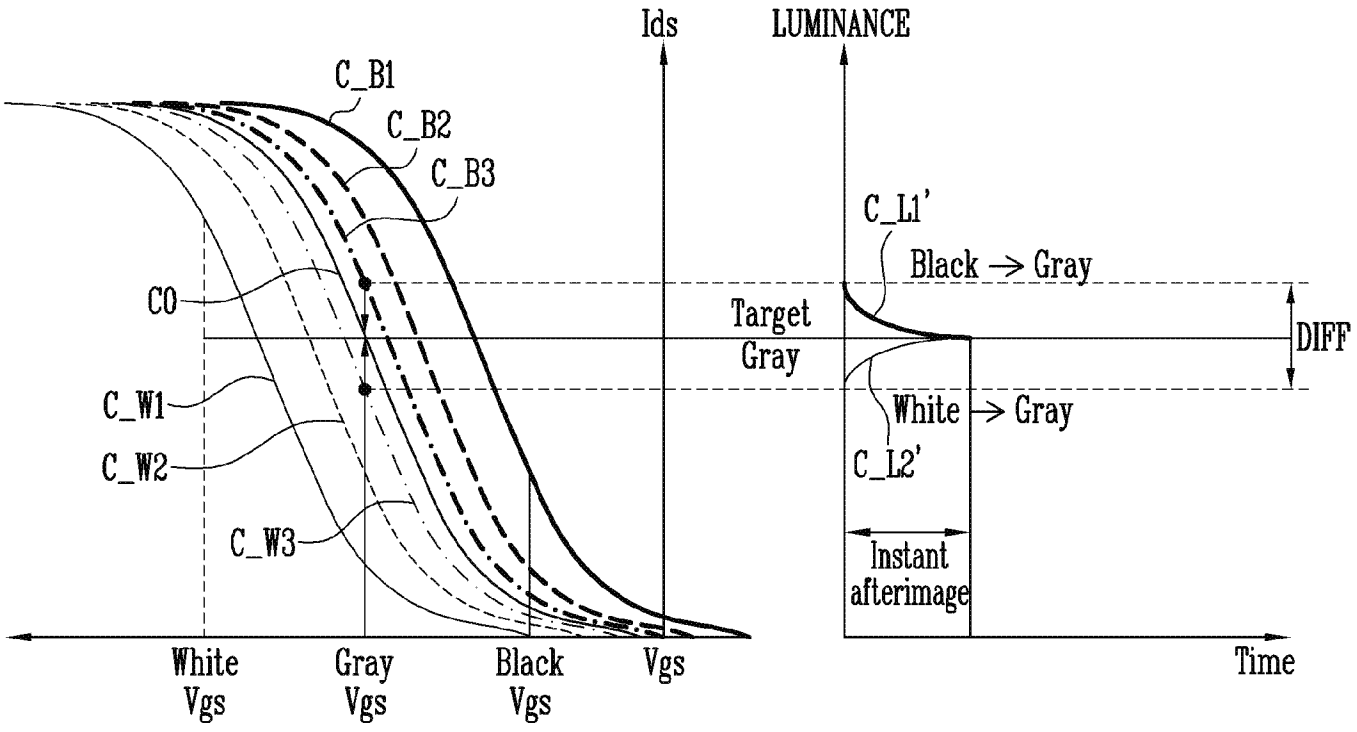
FIG. 5B is a graph illustrating an example of a characteristic of a first transistor included in the pixel shown in FIG. 2A.

FIG. 5A is a graph illustrating a comparative example of a characteristic of the first transistor included in the pixel shown in FIG. 2A. FIG. 5B is a graph illustrating an example of the characteristic of the first transistor included in the pixel shown in FIG. 2A.

Referring to FIGS. 2A and 5A, a first black curve C_B1 represents a voltage-current characteristic of the first transistor T1 (e.g., a relationship between driving currents Ids according to a gate-source voltage Vgs applied between the gate electrode and the source electrode of the first transistor T1) when a voltage (e.g., Black Vgs) corresponding to a minimum grayscale (e.g., a black grayscale) is applied to the gate electrode of the first transistor T1 (and when the pixel PXL does not emit light in the emission period).

A second black curve C_B2 represents a voltage-current characteristic of the first transistor T1, which is changed from the first black curve C_B1 by an initialization operation and a compensation operation, which are repeated in the first period P1, the second period P2, the third period P3, and the fourth period P4, which are described with reference to FIG. 3A.

A reference curve C0 represents a voltage-current characteristic of the first transistor T1 when a voltage (e.g., Gray Vgs) corresponding to a reference grayscale (e.g., grayscale 48 among grayscales in a range of 0 to 255) is applied to the gate electrode of the first transistor T1 (and when the pixel PXL emits light in the emission period).

A first white curve C_W1 represents a voltage-current characteristic of the first transistor T1 when a voltage (e.g., White Vgs) corresponding to a maximum grayscale (e.g., a white grayscale) is applied to the gate electrode of the first transistor T1 (and when the pixel PXL emits light in the emission period).

A second white curve C_W2 represents a voltage-current characteristic of the first transistor T1, which is changed from the first white curve C_W1 by the initialization operation and the compensation operation, which are repeated in the first period P1, the second period P2, the third period P3, and the fourth period P4, which are described with reference to FIG. 3A. That is, the second white curve C_W2 represents a voltage-current characteristic of the first transistor T1 when an on-bias in the first period P1 and the third period P3 and an off-bias in the second period P2 and the fourth period P4 are repeated.

In accordance with the comparative example, the data voltage DATA may be written to the pixel PXL at the same time when the compensation operation of the pixel PXL is performed. For example, the data voltage DATA may be written to the pixel PXL in the second period P2 or the third period P3, which is described with reference to FIG. 3A.

After the pixel PXL emits or does not emit light corresponding to a low grayscale (e.g., a grayscale lower than the grayscale 48 or black grayscale 0) for a certain time, the pixel PXL may emit light corresponding to the reference grayscale (e.g., the grayscale 48). A driving current Ids flowing through the first transistor T1 of the pixel PXL may be changed from a value corresponding to one point on the first black curve C_B1 to a value corresponding to one point on the reference curve C0. That is, when a grayscale value of the pixel PXL is maintained with a low grayscale for a certain time and then changed to a high grayscale, the driving current Ids of the first transistor T1 may be changed to a target current after a certain time.

Corresponding to the change in the driving current Ids, a luminance LUMINANCE of the pixel PXL may be changed from a luminance higher than a target luminance Target Gray to a target luminance Target Gray throughout a specific time. That is, the specific time may be taken until the luminance LUMINANCE of the pixel PXL is equal to the target luminance Target Gray.

Similarly, after the pixel PXL emits light corresponding to a high grayscale (e.g., a grayscale higher than the grayscale 48 or white grayscale 255) for a certain time, the pixel PXL may emit light corresponding to the reference grayscale (e.g., the grayscale 48). The driving current Ids flowing through the first transistor T1 of the pixel PXL may be changed from a value corresponding to one point on the first white curve C_W1 to a value corresponding to one point on the reference curve C0. That is, when the grayscale value of the pixel PXL is maintained with a high grayscale for a certain time and then changed to a low grayscale, the driving current Ids of the first transistor T1 may be changed to a target current throughout a specific time.

Corresponding to the change in the driving current Ids, the luminance LUMINANCE may be changed from a luminance lower than the target luminance Target Gray to the target luminance Target Gray within a certain time. That is, the specific time may be taken until the luminance LUMINANCE of the pixel PXL is equal to the target luminance Target Gray.

That is, according to a hysteresis characteristic of the first transistor T1, a change ΔVth of the threshold voltage of the first transistor T1 may occur, and a luminance difference between adjacent pixels may occur. For example, since a luminance of a first pixel including the first transistor T1 having the voltage-current characteristic according to the second black curve C_B2 and a luminance of a second pixel including the first transistor T1 having the voltage-current characteristic according to the second white curve C_W2 are different from each other (e.g., since a luminance difference DIFF or a current difference occurs), an instant afterimage may occur, and image quality may be deteriorated.

An amount of time taken until a transient contrast ratio (or Michelson Contrast) becomes smaller than a reference ratio (or reference value, e.g., 0.4%) may be defined as an instant afterimage index (or instant afterimage time) representing a size of the instant afterimage. The transient contrast ratio may be defined as a ratio of a difference between a first luminance (or first current) according to a first luminance curve C_L1 and a second luminance (or second current) according to a second luminance curve C_L2 with respect to a sum of the first luminance and the second luminance (e.g., "(L1−L2)/(L1+L2)") (L1 is the first luminance and L2 is the second luminance). An instant afterimage index in accordance with the comparative example may be represented as about 5 seconds to about 8 seconds. Therefore, an instant afterimage may be viewed by a user.

Referring to FIGS. 2A, 3A, and 5B, in the display device 100 (see FIG. 1) in accordance with an exemplary embodiment of the present disclosure, the data voltage DATA may be written to the pixel PXL in the fifth period P5 (e.g., a period different from the first period P1, the second period P2, the third period P3, and the fourth period P4).

A third black curve C_B3 represents a voltage-current characteristic of the first transistor T1, which is changed from the second black curve C_B2 by a data write operation in the fifth period P5, which is described with reference to FIG. 3A.

When a voltage (e.g., Gray Vgs) corresponding to the reference grayscale (e.g., the grayscale 48 among the grayscales in the range of 0 to 255) is applied to the gate electrode of the first transistor T1, the voltage-current characteristic of the first transistor T1 may be changed to come closer to the reference curve C0.

A driving current Ids flowing through the first transistor T1 of the pixel PXL may be changed from a value corresponding to one point on the third black curve C_B3 to a value corresponding to one point on the reference curve C0. A difference between the driving current Ids according to the third black curve C_B3 and the driving current Ids according to the reference curve C0 may be smaller than that between the driving current Ids according to the second black curve C_B2 and the driving current Ids according to the reference curve C0.

A third white curve C_W3 represents a voltage-current characteristic of the first transistor T1, which is changed from the second white curve C_W2 by the data write operation in the fifth period P5, which is described with reference to FIG. 3A.

When a voltage (e.g., Gray Vgs) corresponding to the reference grayscale (e.g., the grayscale 48 among the grayscales in the range of 0 to 255) is applied to the gate electrode of the first transistor T1, the voltage-current characteristic of the first transistor T1 may be changed to come closer to the reference curve C0.

A driving current Ids flowing through the first transistor T1 of the pixel PXL may be changed from a value corresponding to one point on the third white curve C_W3 to a value corresponding to one point on the reference curve C0. A difference between the driving current Ids according to the third white curve C_W3 and the driving current Ids according to the reference curve C0 may be smaller than that between the driving current Ids according to the second white curve C_W2 and the driving current Ids according to the reference curve C0.

A luminance difference DIFF between a luminance a first pixel including the first transistor T1 having the voltage-current characteristic according to the third black curve C_B3 and a luminance of a second pixel including the first transistor T1 having the voltage-current characteristic according to the third white curve C_W3 may become relatively small (compare, for example, the first luminance curve C_L1 and the second luminance curve C_L2 of FIG. 5A with a first luminance curve C_LF and a second luminance curve C_L2' of FIG. 5B, respectively), and an instant afterimage index may be decreased corresponding to the luminance difference DIFF. For example, the instant afterimage index may be about 0.2 s or less or may be about 0.1 s or less. Therefore, in an exemplary embodiment, the luminance difference DIFF is not viewed by a user.

As described with reference to FIGS. 3A, 5A, and 5B, unlike the initialization and compensation periods (e.g., the first period P1, the second period P2, the third period P3, and the fourth period P4), the data voltage DATA is written to the pixel PXL (or the gate electrode of the first transistor T1) in the fifth period P5 allocated before the emission period (e.g., the seventh period P7), so that a bias (or operation point) of the first transistor T1 in the fifth period P5 (e.g., the scan period) may become substantially equal or similar to that of the first transistor T1 in the emission period. Thus, in an exemplary embodiment, the instant afterimage can be reduced or minimized, and the image quality can be improved.

Figure 6A:
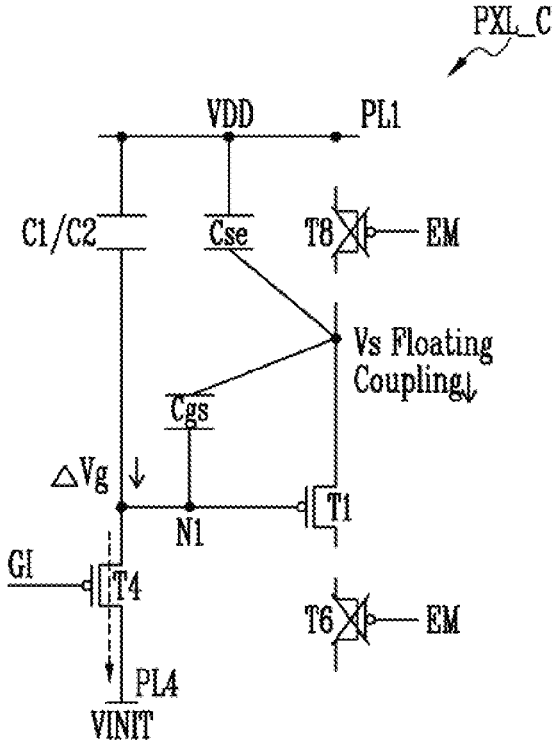
FIG. 6A is a diagram illustrating a comparative example of a source-gate voltage of a first transistor included in the pixel shown in FIG. 2A.
Figure 6B:
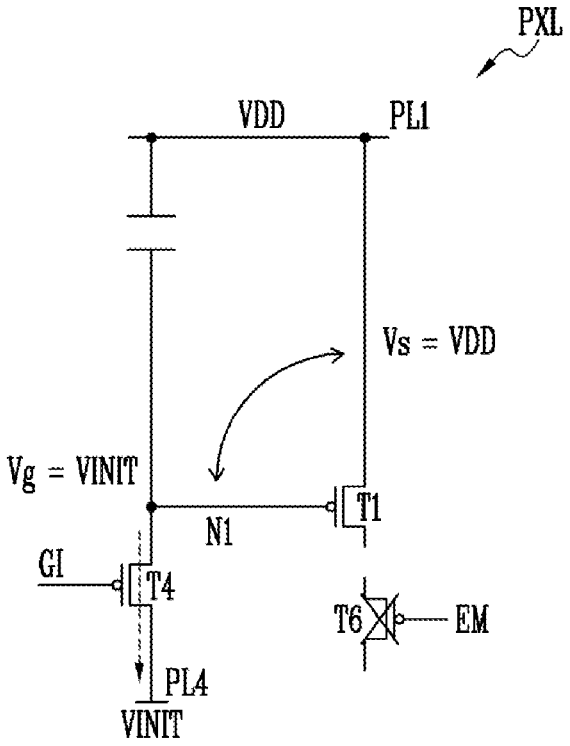
FIG. 6B is a diagram illustrating an example of a source-gate voltage of a first transistor included in the pixel shown in FIG. 2A.
Figure 7:
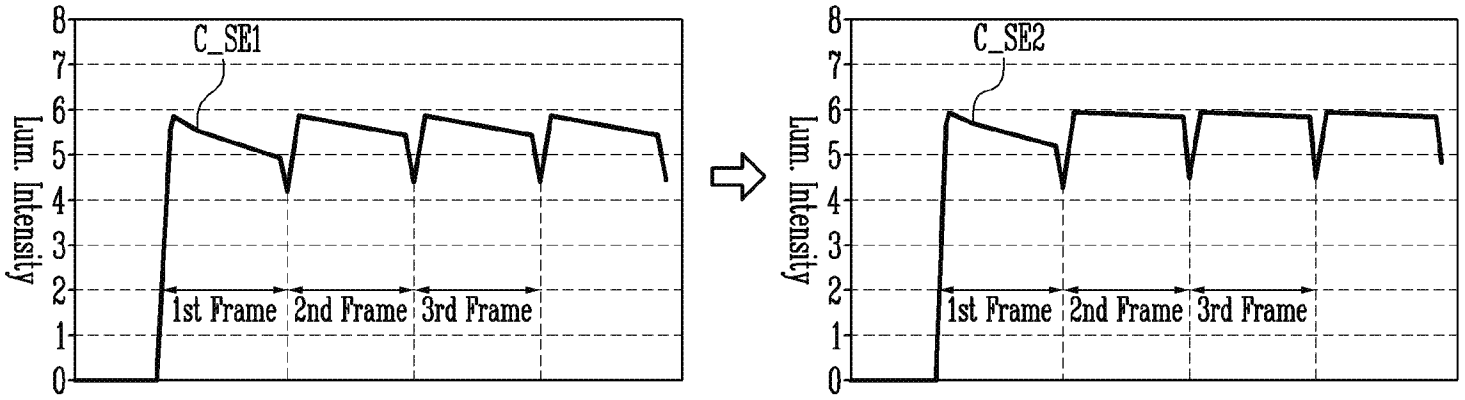
FIG. 7 is a graph illustrating step efficiency of the pixel shown in FIG. 2A.

FIG. 6A is a diagram illustrating a comparative example of a source-gate voltage of the first transistor included in the pixel shown in FIG. 2A. FIG. 6B is a diagram illustrating an example of the source-gate voltage of the first transistor included in the pixel shown in FIG. 2A. Pixels are briefly illustrated in FIGS. 6A and 6B based on components related to an on-bias of the first transistor T1. FIG. 7 is a graph illustrating step efficiency of the pixel shown in FIG. 2A.

First, referring to FIGS. 2A and 6A, the pixel PXL_C in accordance with the comparative example may further include an eighth transistor T8, as compared with the pixel PXL shown in FIG. 2A.

The eighth transistor T8 may include a first electrode connected to the first power line PL1, a second electrode connected to the source electrode (or first electrode) of the first transistor T1, and a gate electrode for receiving the emission control signal EM.

In the first period P1 and the third period P3, which are described with reference to FIG. 3A, the fourth transistor T4 may be turned on in response to the first initialization control signal GI having the gate-on voltage level, and the initialization voltage VINT may be applied to the first node N1. The sixth transistor T6 and the eighth transistor T8 may be turned off in response to the emission control signal EM having the gate-off voltage level, and the source electrode of the first transistor T1 may be floated. A voltage Vs (e.g., a source voltage) of the source electrode of the first transistor T1 may be determined by a first parasitic capacitor Cse and a second parasitic capacitor Cgs. The first parasitic capacitor Cse may be a parasitic capacitor formed between the source electrode of the first transistor T1 and the first power line PL1, and the second parasitic capacitor Cgs may be a parasitic capacitor formed between the gate electrode of the first transistor T1 and the source electrode of the first transistor T1.

A source-gate voltage applied between the source electrode and the gate electrode of the first transistor T1 may be in proportion to a difference ΔVg between the first power voltage VDD applied to the first power line PL1 and the voltage (e.g., the initialization voltage VINIT) of the source electrode of the first transistor T1 and the first parasitic capacitor Cse, and be in inverse proportion to the second parasitic capacitor Cgs (e.g., "Vgs=Cse/Cgs×ΔVg"). For example, the source-gate voltage Vsg (or on-bias voltage) of the first transistor T1 may be about −4 V.

Referring to FIGS. 2A and 6B, the source electrode (or first electrode) of the first transistor T1 in accordance with an exemplary embodiment of the present disclosure may be directly connected to the first power line PL1. That is, the source electrode of the first transistor T1 may be non-floated, and the voltage Vs (e.g., the source voltage) of the source electrode of the first transistor T1 may be equal to the first power voltage VDD.

In the first period P1 and the third period P3, which are described with reference to FIG. 3A, the fourth transistor T4 may be turned on in response to the first initialization control signal GI having the gate-on voltage level, and the initialization voltage VINIT may be applied to the first node N1. Therefore, the source-gate voltage Vsg applied between the source electrode and the gate electrode of the first transistor T1 may be equal to a difference between the first power voltage VDD applied to the first power line PL1 and the initialization voltage VINIT (e.g., Vsg=VDD−VINIT). For example, the source-gate voltage Vsg (or on-bias voltage) of the first transistor T1 may be about −8 V.

When the on-bias voltage (or on-bias amount) of the first transistor T1 increases, step efficiency may be improved. The step efficiency may be a phenomenon in which, when the display device which has displayed a black image in previous frames displays a white image in subsequent frames, a luminance of the display device is lower than a desired luminance (e.g., a target luminance) in a first frame in which the white image is displayed. That is, when an image is changed from the black image to the white image, a change in luminance does not immediately occur, but the luminance is gradually changed in a step form throughout some frames, and a rate of the luminance in the first frame to the desired luminance may be defined as the step efficiency.

Referring to FIG. 7, a first step efficiency graph C_SE1 represents luminance of the pixel (e.g., the pixel PXL_C in accordance with the comparative example) shown in FIG. 6A when the image is changed from the black image to the white image.

In a first frame 1st Frame of the first step efficiency graph C_SE1, the luminance (or luminance intensity Lum. Intensity) of the pixel PXL_C in accordance with the comparative example is lower than a target luminance (e.g., a luminance intensity of 6). In a second frame 2nd Frame and a third frame 3rd Frame, the luminance of the pixel PXL_C in accordance with the comparative example may come relatively close to the target luminance. For example, the step efficiency of the pixel PXL_C in accordance with the comparative example (and a display device including the pixel PXL_C in accordance with the comparative example) may be about 85%.

A second step efficiency graph C_SE2 represents luminance of the pixel PXL in accordance with an exemplary embodiment of the present disclosure, when the image is changed from the black image to the white image.

In a first frame 1st Frame of the second step efficiency graph C_SE2, the luminance (or luminance intensity Lum. Intensity) of the pixel PXL in accordance with an exemplary embodiment of the present disclosure has a value which comes close to the target luminance (e.g., the luminance intensity of 6). For example, the step efficiency of the pixel PXL (and the display device 100 shown in FIG. 1) may be about 92.6% or more. In a third frame 3rd Frame, the luminance ratio (e.g., a ratio of an actual luminance to the target luminance) of the pixel PXL may be about 93.7%. That is, the step efficiency of the pixel PXL can be improved according to exemplary embodiments.

As described with reference to FIGS. 6A, 6B, and 7, the source electrode of the first transistor T1 is directly connected to the first power line PL1, and is non-floated. Thus, according to exemplary embodiments, the on-bias voltage (or on-bias amount) of the first transistor T1 can increase, and the step efficiency can be improved.

Figure 8:
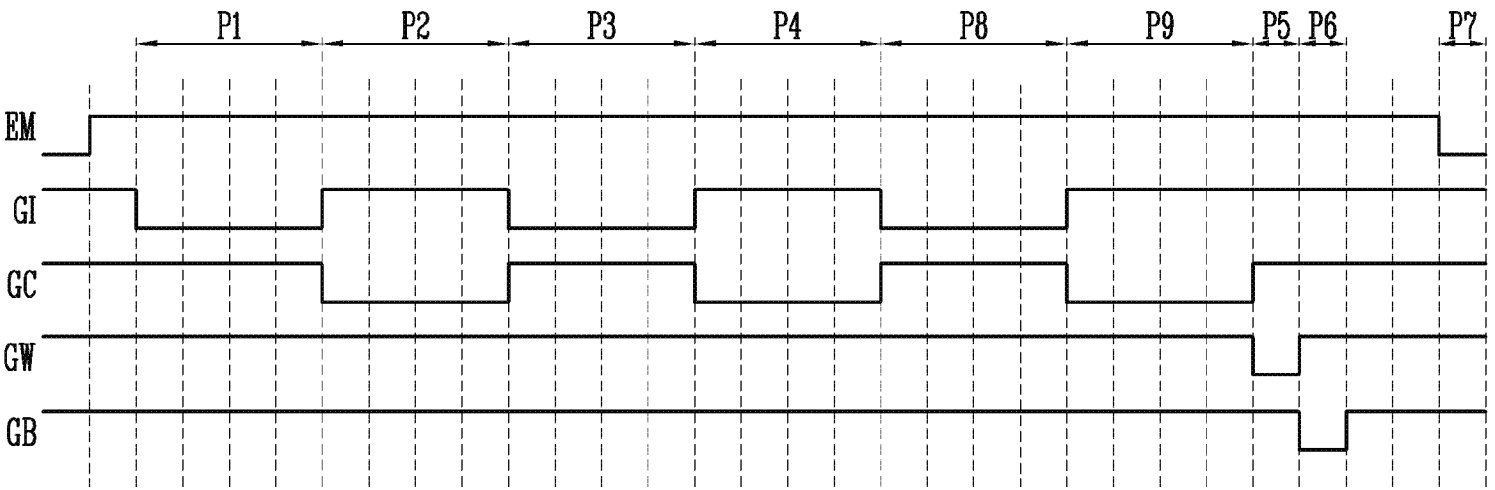
FIG. 8 is a waveform diagram illustrating another example of the signals provided to the pixel shown in FIG. 2A.

FIG. 8 is a waveform diagram illustrating another example of the signals provided to the pixel shown in FIG. 2A. For example, a diagram corresponding to FIG. 3A is illustrated in FIG. 8.

Referring to FIGS. 2A, 3A, and 8, the period in which the emission control signal EM has the gate-off voltage level (e.g., the turn-off voltage level, which may be a logic high level) (e.g., the non-emission period of the pixel PXL) may further include an eighth period P8 and a ninth period P9. The eighth period P8 and the ninth period P9 may be located between the fourth period P4 and the fifth period P5.

Operations of the pixel PXL in the first period P1, the second period P2, the third period P3, the fourth period P4, the fifth period P5, the sixth period P6, and the seventh period P7 are substantially identical to those of the pixel PXL as described with reference to FIG. 3A. Thus, for convenience of explanation, a further description of aspects previously described will not be repeated.

During the eighth period P8, the first initialization control signal GI may have a gate-on voltage level. A width of the eighth period P8 may be equal to that of the first period P1 (and the third period P3). For example, the width of the eighth period P8 may be four horizontal time intervals. Each of the compensation control signal GC, the scan signal GW, and the second initialization control signal GB may have a gate-off voltage level.

Similar to the operation of the pixel PXL in the third period P3, which is described with reference to FIG. 4C, the fourth transistor T4 may be turned on in response to the first initialization control signal GI having the gate-on voltage level, and the initialization voltage VINIT may be tertiarily provided to the first node N1. That is, the first node N1 (or the gate electrode of the first transistor T1) may be initialized by the initialization voltage VINIT in the eighth period P8. The voltage Va of the second node N2 may be maintained equal to the reference voltage VREF applied in the fourth period P4 by the reference voltage VREF.

During the ninth period P9, the compensation control signal GC may have a gate-on voltage level. A width of the ninth period P9 may be equal to that of the second period P2 (and the fourth period P4). For example, the width of the ninth period P9 may be four horizontal time intervals. Each of the first initialization control signal GI, the scan signal GW, and the second initialization control signal GB may have a gate-off voltage level.

Similar to the operation of the pixel PXL in the fourth period P4, which is described with reference to FIG. 4D, the fifth transistor T5 may be turned on in response to the compensation control signal GC having the gate-on voltage level, and the reference voltage VREF may be tertiarily provided to the second node N2. In addition, the third transistor T3 may be turned on in response to the compensation control signal GC having the gate-on voltage level, and the gate electrode and the drain electrode (or second electrode) of the first transistor T1 may be connected to each other.

A voltage corresponding to a difference (or voltage difference) between the first power voltage VDD and the threshold voltage of the first transistor T1 may be sampled at the first node N1. The voltage Vg of the first node N1 may be equal to the difference between the first power voltage VDD and the threshold voltage of the first transistor T1.

Since the voltage Va of the second node N2 is in a state in which the voltage Va is maintained as the reference voltage VREF, a component of a previous data voltage may be completely removed from the voltage Vg of the first node N1. Thus, the voltage Vg of the first node N1 can be more accurately compensated.

As described with reference to FIG. 8, each of the first initialization control signal GI and the compensation control signal GC includes three pulses of a gate-on voltage level. Thus, a component (or influence) of the previous data voltage is more certainly removed from the voltage Vg of the first node N1, and the threshold voltage of the first transistor T1 can be more accurately compensated by the voltage Vg of the first node N1 (or the voltage of the gate electrode of the first transistor T1).

FIGS. 9A, 9B, 9C, and 9D are waveform diagrams illustrating an example of the signals provided to the pixel shown in FIG. 2A according to a driving frequency. For example, a diagram corresponding to FIG. 3A is illustrated in FIGS. 9A, 9B, 9C, and 9D.

Referring to FIGS. 1, 3A, 9A, 9B, 9C, and 9D, the display device 100 may be driven to display an image at different driving frequencies. That is, the display device 100 may be driven at a variable refresh rate (VRR). Hereinafter, a case in which it is assumed that one frame (or unit frame) corresponds to a frequency of 240 Hz is described for convenience of description.

Figure 9A:
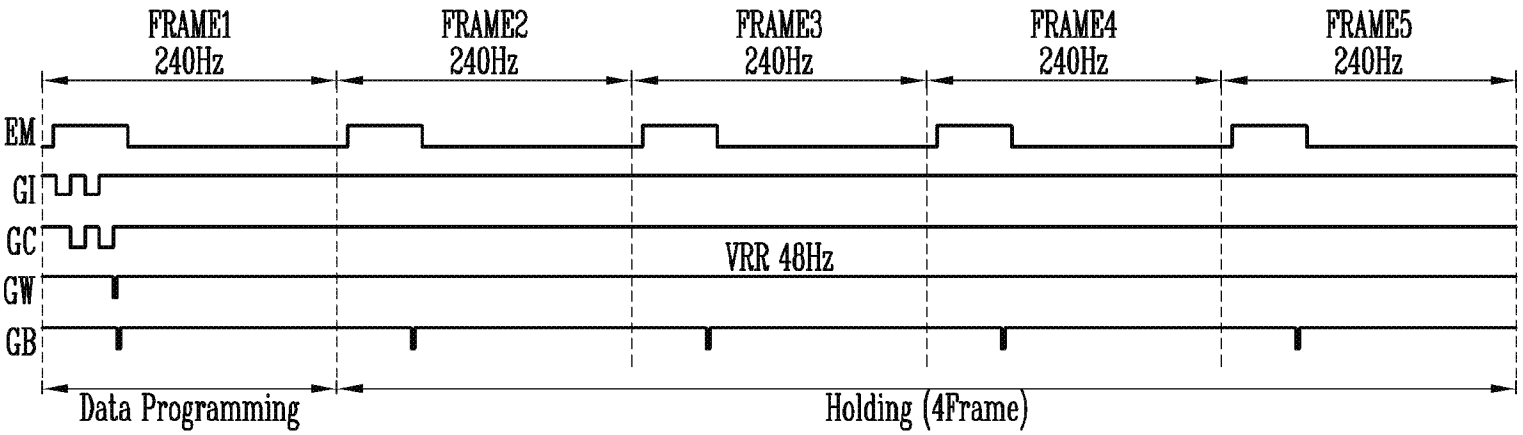
FIGS. 9A, 9B, 9C, and 9D are waveform diagrams illustrating an example of the signals provided to the pixel shown in FIG. 2A according to a driving frequency.

As shown in FIG. 9A, in a first mode, the display device 100 may be driven at a first driving frequency (e.g., 48 Hz). For example, the display device 100 may be driven in a period including five frames.

An operation of the display device 100 in a first frame FRAME1 (or first frame period) may be substantially identical to that of the display device 100 in the first period P1 to the seventh period P7, which is described with reference to FIG. 3A. However, the present disclosure is not limited thereto. For example, in the first frame FRAME1, the emission control signal EM, the first initialization control signal GI, the compensation control signal GC, the scan signal GW, and the second initialization control signal GB may have the waveforms shown in FIG. 3B or have the waveforms shown in FIG. 8.

In the first frame FRAME1, since the scan signal GW, the first initialization control signal GI, and the compensation control signal GC have a gate-on voltage level (e.g., a turn-on voltage level, which may be a logic low level), a data voltage (or data signal) may be written to the pixel PXL (e.g., Data Programming), and the pixel PXL may emit light with a luminance corresponding to the data voltage in response to the emission control signal EM having a gate-on voltage level.

In a second frame FRAME2, a third frame FRAME3, a fourth frame FRAME4, and a fifth frame FRAME5, the scan signal GW, the first initialization control signal GI, and the compensation control signal GC may have a gate-off voltage level (e.g., a turn-off voltage level, which may be a logic high level). Therefore, the data voltage is not written to the pixel PXL. The pixel PXL may maintain the data voltage written in the first frame FRAME1 during four frames (e.g., Holding), and emit light with a luminance corresponding to the pre-written data voltage in response to the emission control signal EM having the gate-on voltage level.

In a non-emission period (e.g., a period in which the emission control signal EM has a gate-off voltage level) of each of the second frame FRAME2, the third frame FRAME3, the fourth frame FRAME4, and the fifth frame FRAME5, the second initialization control signal GB may have a pulse of a gate-on voltage level. The seventh transistor T7 in the pixel PXL may be turned on in response to the second initialization control signal GB, and the anode electrode of the light emitting element LD may be initialized for every frame. Therefore, like the first frame FRAME1, the display device 100 may display an image with a uniform luminance in the second frame FRAME2, the third frame FRAME3, the fourth frame FRAME4, and the fifth frame FRAME5.

Figure 9B:
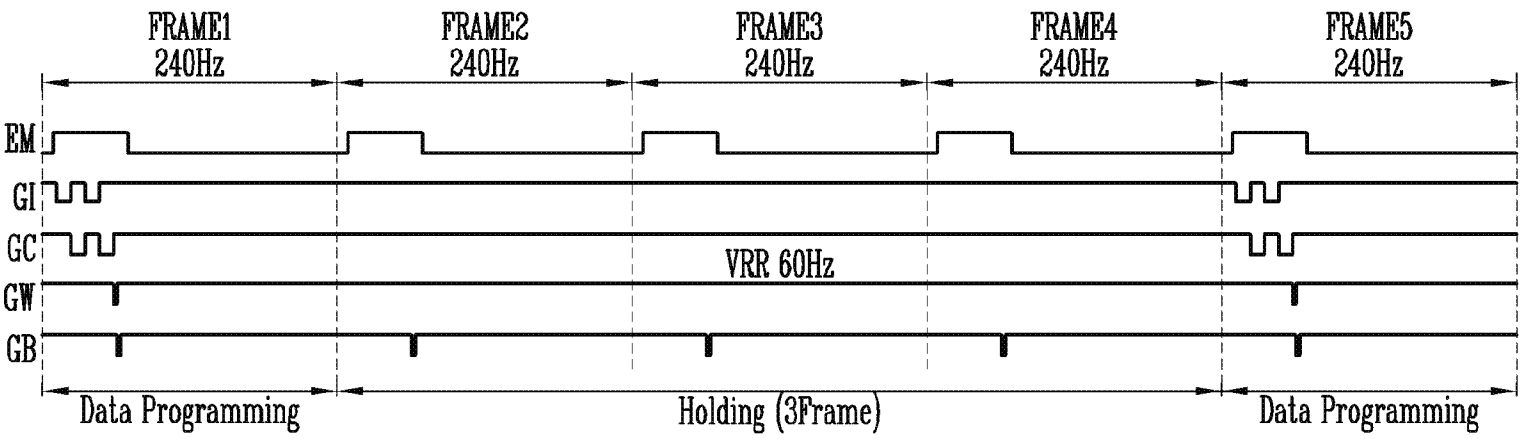

As shown in FIG. 9B, in a second mode, the display device 100 may be driven at a second driving frequency (e.g., 60 Hz). For example, the display device 100 may be driven in a period including four frames. An operation of the display device 100 in a first frame FRAME1 may be substantially identical to that of the display device 100 in the first frame FRAME1 as described with reference to FIG. 9A, and operations of the display device 100 in a second frame FRAME2 to a fourth frame FRAME4 may be substantially identical to that of the display device 100 in the second frame FRAME2 as described with reference to FIG. 9A. Therefore, for convenience of explanation, a further description of aspects previously described will not be repeated.

That is, the display device 100 may write a data voltage to the pixel PXL in response to the first initialization control signal GI, the compensation control signal GC, and the scan signal GW, which have a gate-on voltage level, in the first frame FRAME1, and maintain the pre-written data voltage in the second frame FRAME2 and the third frame FRAME3.

Figure 9C:
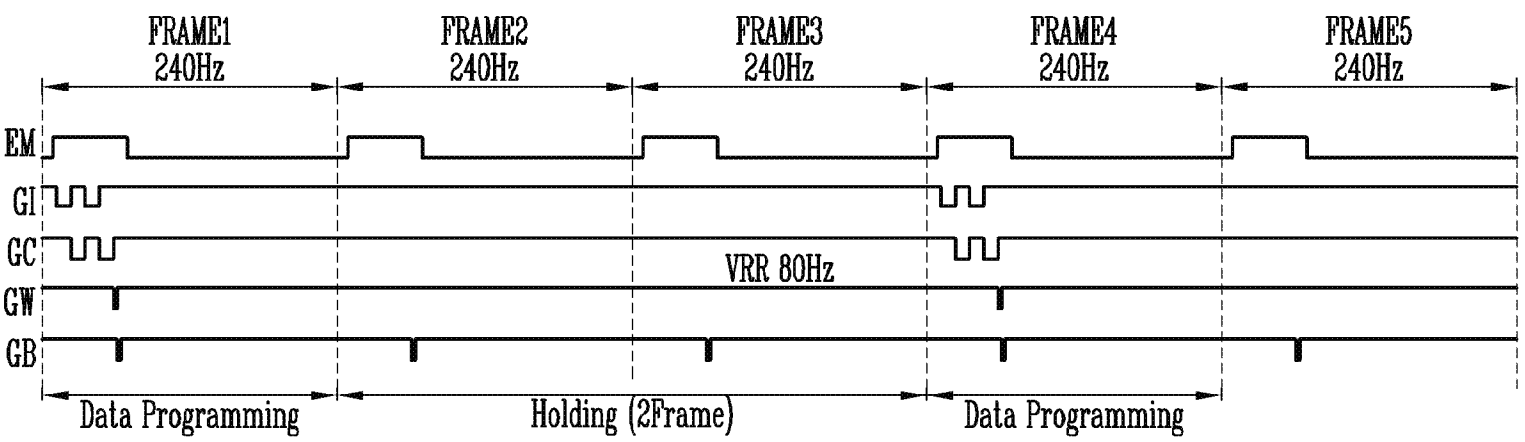
Figure 9D:
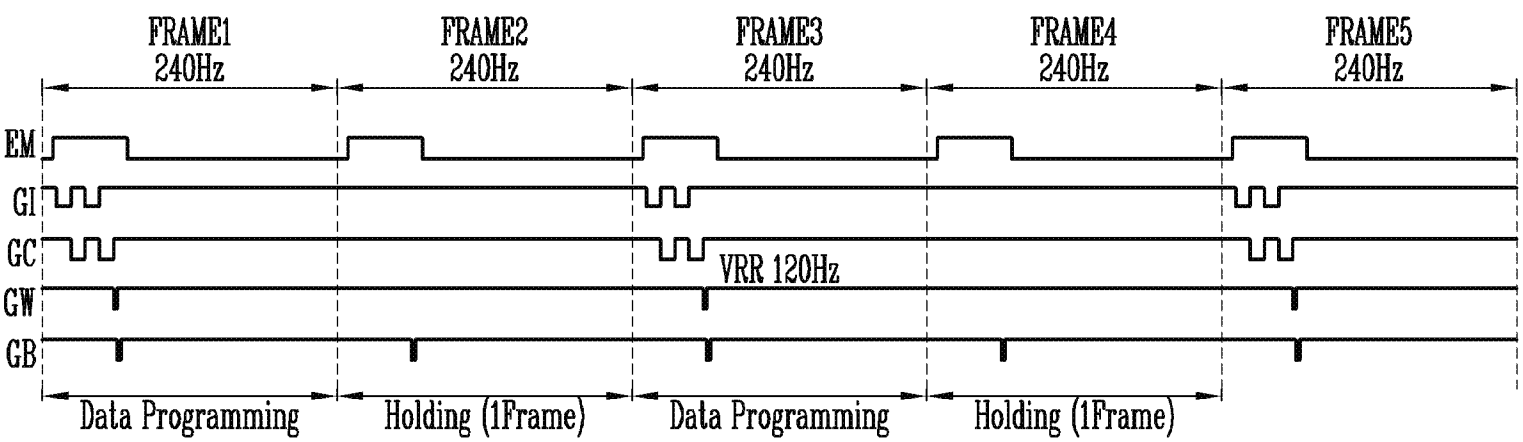

As shown in FIG. 9C, in a third mode, the display device 100 may be driven at a third driving frequency (e.g., 80 Hz). For example, the display device 100 may be driven in a period including three frames. The display device 100 may write a data voltage in a first frame FRAME1, and maintain the pre-written data voltage in a second frame FRAME2 to a fourth frame FRAME4. As shown in FIG. 9D, in a fourth mode, the display device 100 may be driven at a fourth driving frequency (e.g., 120 Hz). For example, the display device 100 may be driven in a period including two frames. The display device 100 may write a data voltage in a first frame FRAME1, and maintain the pre-written data voltage in a second frame FRAME2.

As described with reference to FIGS. 9A, 9B, 9C, and 9D, the display device 100 can be driven at a variable refresh rate (VRR). A data voltage (or data signal) can be written to the pixel PXL in a data programming period (e.g., the first frame FRAME1 shown in FIG. 9A), and the pre-written data voltage in the pixel PXL can be maintained in a holding frame period (e.g., the period from the second frame FRAME2 to the fifth frame FRAME5 shown in FIG. 9A). In the holding frame period, only the emission control signal EM and the second initialization control signal GB periodically have a gate-on voltage level, so that the display device 100 can display an image with an entirely uniform luminance in the data programming period and the holding frame period.

Figure 10:
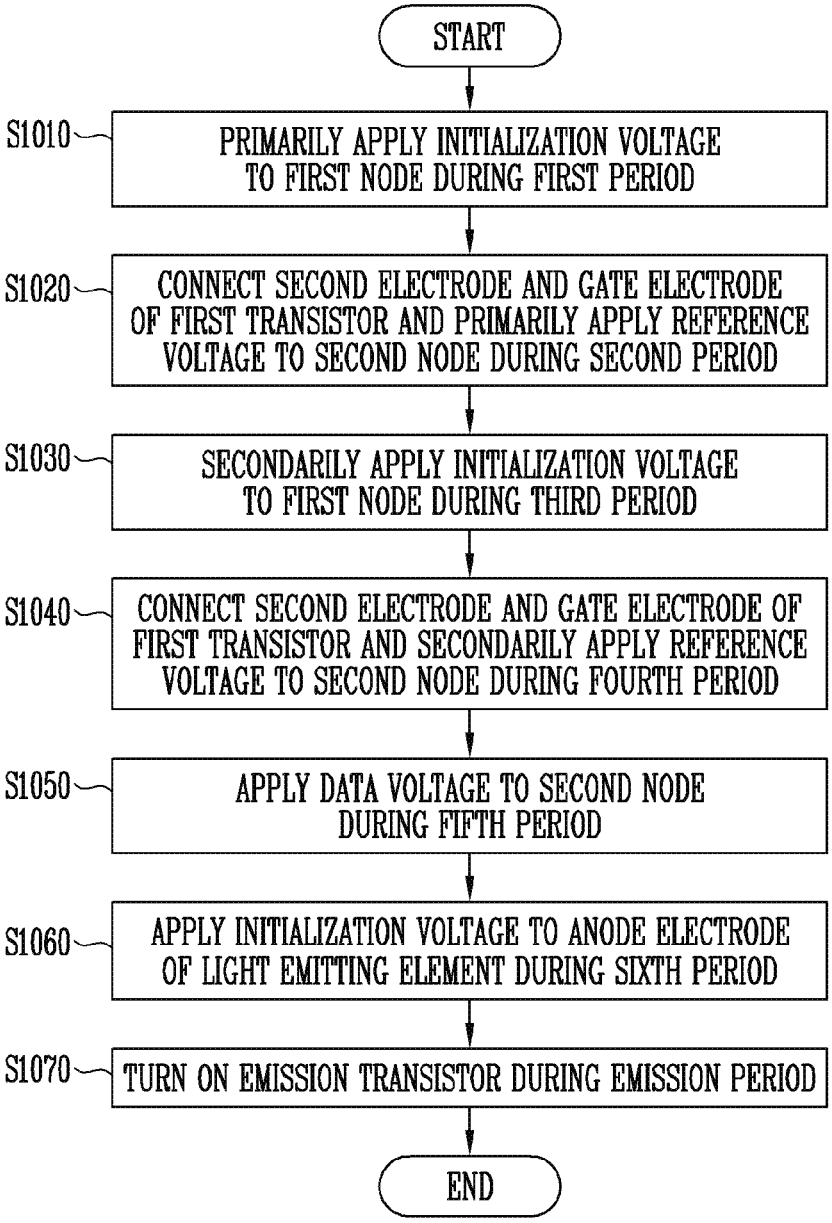
FIG. 10 is a flowchart illustrating a method of driving a display device in accordance with an exemplary embodiment of the present disclosure.

FIG. 10 is a flowchart illustrating a method of driving a display device in accordance with an exemplary embodiment of the present disclosure.

Referring to FIGS. 1, 2A, 3A, and 10, the method shown in FIG. 10 may be performed in the display device 100 shown in FIG. 1.

In the method shown in FIG. 10, during a first period P1, the initialization voltage VINIT may be primarily applied to the first node N1 (e.g., the gate electrode of the first transistor T1) (S1010). A width of the first period P1 may be three horizontal time intervals or more.

As described with reference to FIGS. 3A and 4A, the first initialization control signal GI may have a gate-on voltage level. The fourth transistor T4 may be turned on in response to the first initialization control signal GI, and the initialization voltage VINIT may be primarily provided to the first node N1.

In the method shown in FIG. 10, during a second period P2, the second electrode (or drain electrode) and the gate electrode of the first transistor T1 may be connected to each other, and simultaneously, the reference voltage VREF may be primarily applied to the second node N2 (S1020). A width of the second period P2 may be three horizontal time intervals or more.

As described with reference to FIGS. 3A and 4B, the compensation control signal GC may have a gate-on voltage level, and the third transistor T3 and the fifth transistor T5 may be turned on in response to the compensation control signal GC. The reference voltage VREF may be primarily provided to the second node N2 through the turned-on fifth transistor T5, and the second node N2 may be initialized by the reference voltage VREF. In addition, the first transistor T1 is diode-connected through the turned-on third transistor T3, and the threshold voltage of the first transistor T1 may be sampled at the first node N1.

In the method shown in FIG. 10, during a third period P3, the initialization voltage VINIT may be secondarily applied to the first node N1 (e.g., the gate electrode of the first transistor T1) (S1030). A width of the third period P3 may be three horizontal time intervals or more.

As described with reference to FIGS. 3A and 4C, the first initialization control signal GI may have a gate-on voltage level. The fourth transistor T4 may be turned on in response to the first initialization control signal GI, and the initialization voltage VINIT may be secondarily provided to the first node N1. That is, the voltage of the gate electrode of the first transistor T1 may again be initialized.

In the method shown in FIG. 10, during the fourth period P4, the second electrode (or drain electrode) and the gate electrode of the first transistor T1 may be connected to each other, and simultaneously, the reference voltage VREF may be secondarily applied to the second node N2 (S1040). A width of the fourth period P4 may be three horizontal time intervals or more.

As described with reference to FIGS. 3A and 4D, the compensation control signal GC may have a gate-on voltage level, and the third transistor T3 and the fifth transistor T5 may be turned on in response to the compensation control signal GC. The reference voltage VREF may be secondarily provided to the second node N2 through the turned-on fifth transistor T5, and the second node N2 may be initialized by the reference voltage VREF. In addition, the first transistor T1 may be diode-connected through the turned-on third transistor T3, and the threshold voltage of the first transistor T1 may be sampled at the first node N1. Since the voltage Va of the second node N2 is in a state in which the voltage Va is maintained as the reference voltage VREF, a component of a previous data voltage may be removed from the voltage Vg of the first node N1. Thus, as compared with the second period P2, the threshold voltage of the first transistor T1 can be more accurately sampled, and the voltage Vg of the first node N1 can be more accurately compensated.

In some exemplary embodiments, in the method shown in FIG. 10, a step of applying the initialization voltage VINIT to the first node N1 (e.g., the gate electrode of the first transistor T1) and a step of connecting the second electrode (or drain electrode) and the gate electrode of the first transistor T1, and simultaneously applying the reference voltage VREF to the second node N2, may be additionally repeated once or more after the fourth period P4.

That is, in the method shown in FIG. 10, an initialization operation of initializing the first node N1 and a compensation operation of sampling the threshold voltage of the first transistor T1 may be repeated a total of three or more times. The component (or influence) of the previous data voltage can be more accurately removed from the voltage Vg of the first node N1.

In the method shown in FIG. 10, during a fifth period P5 (or scan period), a data voltage DATA may be applied to the second node N2 (S1050). A width of the fifth period P5 may be one horizontal time interval.

As described with reference to FIGS. 3A and 4E, the scan signal GW may have a gate-on voltage level. The second transistor T2 may be turned on in response to the scan signal GW, and the data voltage DATA may be provided to the second node N2.

After the threshold voltage of the first transistor T1 is compensated (or sampled) and before an emission period, the data voltage DATA is written, so that an instant afterimage can be minimized or reduced as described with reference to FIGS. 5A and 5B.

In the method shown in FIG. 10, during a sixth period P6, the initialization voltage VINIT may be applied to the anode electrode of the light emitting element LD (S1060).

As described with reference to FIGS. 3A and 4F, the second initialization control signal GB may have a gate-on voltage level. The seventh transistor T7 may be turned on in response to the second initialization control signal GB, and the initialization voltage VINIT may be provided to the anode electrode of the light emitting element LD. The parasitic capacitor of the light emitting element LD is initialized by the initialization voltage VINIT, and the pixel PXL can exhibit a more uniform luminance characteristic.

In the method shown in FIG. 10, during an emission period (or seventh period P7), the sixth transistor T6 (or emission transistor) may be turned on (S1070).

The emission control signal EM may have a gate-on voltage level. The sixth transistor T6 may be turned on in response to the emission control signal EM, a driving current may flow through the turned-on sixth transistor T6, and the light emitting element LD may emit light with a luminance corresponding to the driving current.

As described with reference to FIG. 10, in the driving method of the display device in accordance with an exemplary embodiment of the present disclosure, the initialization operation of initializing the first node N1 (e.g., the gate electrode of the first transistor T1) and the compensation operation of sampling the threshold voltage of the first transistor T1 can be repeated three or more times. Thus, the component (or influence) of the previous data voltage can be removed from the voltage Vg of the first node N1, and the threshold voltage of the first transistor T1 can be more accurately compensated by the voltage Vg of the first node N1 (or the voltage of the gate electrode of the first transistor T1).

Further, in the method shown in FIG. 10, separately from the compensation operation, the data voltage can be written to the pixel PXL during one horizontal time interval just before the emission period. Thus, a bias (or operation point) of the first transistor T1 becomes equal or similar to that of the first transistor T1 in the emission period. Accordingly, an instant afterimage can be reduced or minimized, and image quality can be improved.

In a comparative example, a display device may include a first data line and a second data line, which correspond to one pixel column, may provide a first data signal to odd-numbered pixels in the pixel column through the first data line, and may provide a second data signal to even-numbered pixels in the pixel column through the second data line. A number of pixels connected to each of the first and second data lines may decrease, and a data write time may increase. Such a display device including a plurality of data lines corresponding to one pixel column requires a larger number of data lines as the resolution and driving frequency of the display device increase. As the number of data lines increases, manufacturing cost is increased, and a dead space for disposing the data lines and other components may also be increased.

In a display device and a method of driving the same in accordance with exemplary embodiments of the present disclosure, a compensation period in which a threshold voltage of a first transistor (or driving transistor) is sampled (and compensated) and a data write period in which a data voltage is written to a gate electrode of the first transistor are separated from each other, and a width of the compensation period is set to three or more horizontal time intervals (e.g., about 3.2 μs or more).

Further, in a display device and a method of driving the same in accordance with exemplary embodiments of the present disclosure, an initialization operation of initializing the gate electrode of the first transistor and a compensation operation of sampling (and compensating for) the threshold voltage of the first transistor are sequentially repeated three or more times. Thus, a component (or influence) of a previous data voltage can be removed from a voltage applied to the gate electrode of the first transistor, and the threshold voltage of the first transistor can be more accurately compensated.

Further, in a display device and a method of driving the same in accordance with exemplary embodiments of the present disclosure, separately from the compensation operation, the data voltage is written to a pixel during one horizontal time interval just before an emission period. Thus, a bias (or operation point) of the first transistor becomes equal or similar to that of the first transistor in the emission period. Accordingly, an instant afterimage can be reduced or improved, and image quality can be improved.

While the present disclosure has been particularly shown and described with reference to the exemplary embodiments thereof, it will be understood by those of ordinary skill in the art that various changes in form and detail may be made therein without departing from the spirit and scope of the present disclosure as defined by the following claims.

What is claimed is:

1. A display device, comprising:

a first power line;

a second power line;

a reference power line;

an initialization power line;

a data line configured to transfer a data signal;

a first scan line and a second scan line, configured to sequentially transfer a scan signal;

a first gate line and a second gate line, configured to sequentially transfer a gate signal;

an emission control line configured to transfer an emission control signal; and a pixel, wherein the pixel comprises:

a first transistor comprising a first electrode connected to the first power line, a second electrode connected to a third node, and a gate electrode connected to a first node;

a first capacitor formed between the first power line and a second node;

a second capacitor formed between the first node and the second node;

a second transistor comprising a third electrode connected to the data line, a fourth electrode connected to the second node, and a gate electrode connected to the first scan line;

a third transistor comprising a fifth electrode connected to the first node, a sixth electrode connected to the third node, and a gate electrode connected to the first gate line;

a fourth transistor comprising a seventh electrode connected to the first node, an eighth electrode connected to the initialization power line, and a gate electrode connected to the second gate line;

a fifth transistor comprising a ninth electrode connected to the second node, a tenth electrode connected to the reference power line, and a gate electrode connected to the first gate line;

a sixth transistor comprising an eleventh electrode connected to the third node, a twelfth electrode, and a gate electrode connected to the emission control line; and a seventh transistor comprising a thirteenth electrode connected to the initialization power line, a fourteenth electrode connected to an anode electrode of a light emitting element, and a gate electrode connected to the second scan line, and the light emitting element connected between the twelfth electrode of the sixth transistor and the second power line.

2. The display device of claim 1, wherein at least one among the second transistor, the third transistor, the fourth transistor, and the fifth transistor is implemented as a dual gate transistor comprising a plurality of sub-transistors connected in series.

3. The display device of claim 1, wherein the gate signal is provided to the second gate line and the first gate line, and the gate signal provided to the second gate line comprises a plurality of pulses having a gate-on voltage level in one frame.

4. The display device of claim 3, wherein each of the pulses has a same pulse width, wherein the gate signal provided to the first gate line has a waveform in which the gate signal provided to the second gate line is shifted by the pulse width.

5. A display device comprising:

a first power line;

a second power line;

a reference power line;

an initialization power line;

a data line configured to transfer a data signal;

a first scan line configured to transfer a scan signal;

a first gate line and a second gate line, configured to sequentially transfer a gate signal;

an emission control line configured to transfer an emission control signal;

a pixel, wherein the pixel comprises:

a first transistor comprising a first electrode connected to the first power line, a second electrode connected to a third node, and a gate electrode connected to a first node;

a first capacitor formed between the first power line and a second node;

a second capacitor formed between the first node and the second node;

a second transistor comprising a third electrode connected to the data line, a fourth electrode connected to the second node, and a gate electrode connected to the first scan line;

a third transistor comprising a fifth electrode connected to the first node, a sixth electrode connected to the third node, and a gate electrode connected to the first gate line;

a fourth transistor comprising a seventh electrode connected to the first node, an eighth electrode connected to the initialization power line, and a gate electrode connected to the second gate line;

a fifth transistor comprising a ninth electrode connected to the second node, a tenth electrode connected to the reference power line, and a gate electrode connected to the first gate line;

a sixth transistor comprising an eleventh electrode connected to the third node, a twelfth electrode, and a gate electrode connected to the emission control line; and a light emitting element connected between the twelfth electrode of the sixth transistor and the second power line; and a scan driver configured to provide the gate signal having a gate-on voltage level to the second gate line in a first period and a third period, provide the gate signal having the gate-on voltage level to the first gate line in a second period and a fourth period, and provide the scan signal having the gate-on voltage level to the first scan line in a scan period, wherein the first period, the second period, the third period, and the fourth period are sequentially located in one frame, and do not overlap one another.

6. The display device of claim 5, wherein the one frame comprises a non-emission period and an emission period, wherein the first period, the second period, the third period, the fourth period, and the scan period are included in the non-emission period, and do not overlap one another, wherein the scan driver provides the emission control signal having the gate-on voltage level to the emission control line in the emission period.

7. The display device of claim 6, wherein a width of each of the first to fourth periods is three or more times a width of the scan period.

8. The display device of claim 7, wherein the width of each of the first to fourth periods is four times the width of the scan period.

9. The display device of claim 7, wherein the width of the scan period is one horizontal time interval.

10. The display device of claim 9, wherein, in the second period, the first node has a voltage corresponding to a difference between a first power voltage applied to the first power line and a threshold voltage of the first transistor, wherein the voltage of the first node is changed depending on a previous data voltage of a previous frame, wherein, in the fourth period, the first node has a voltage substantially equal to the difference between the first power voltage and the threshold voltage of the first transistor.

11. The display device of claim 9, wherein an operation point of the first transistor in the scan period is substantially equal to the operation point of the first transistor in the emission period.

12. The display device of claim 6, further comprising:

a seventh transistor comprising a thirteenth electrode connected to the initialization power line, a fourteenth electrode connected to an anode electrode of the light emitting element, and a gate electrode connected to a second scan line, wherein the scan driver provides the scan signal having the gate-on voltage level to the second scan line after the scan period.

13. The display device of claim 12, wherein the scan signal provided to the second scan line has a waveform in which the scan signal provided to the first scan line is shifted by the scan period.

14. The display device of claim 10, wherein, between the fourth period and the scan period, the scan driver further sequentially provides the gate signal having the gate-on voltage level to the second gate line and the first gate line.

15. The display device of claim 5, wherein the gate signal provided to the first gate line has a waveform in which the gate signal provided to the second gate line is shifted by the first period.

16. A method of driving a display device, comprising:

primarily applying an initialization voltage to a first node during a first period, wherein the display device comprises a first transistor comprising a first electrode connected to a first power line, a second electrode connected to a third node, and a gate electrode connected to the first node;

primarily applying a reference voltage to a second node in a state in which the second electrode of the first transistor and the gate electrode of the first transistor are connected, during a second period, wherein the display device further comprises a first capacitor formed between the first power line and the second node, and a second capacitor formed between the first node and the second node;

secondarily applying the initialization voltage to the first node during a third period;

secondarily applying the reference voltage to the second node in a state in which the second electrode of the first transistor and the gate electrode of the first transistor are connected, during a fourth period;

applying a data voltage to the second node during a scan period; and turning on an emission transistor during an emission period, wherein the display device further comprises the emission transistor comprising a first electrode connected to the third node, a second electrode, and a gate electrode connected to an emission control line, and a light emitting element connected to the second electrode of the emission transistor and a second power line, and wherein the first to fourth periods are included in one frame, and do not overlap one another.

17. The method of claim 16, wherein the first to fourth periods are included in a non-emission period of the one frame.

18. The method of claim 17, wherein a width of each of the first to fourth periods is three or more times a width of the scan period.

19. The method of claim 18, wherein the width of the scan period is one horizontal time interval.

20. The method of claim 16, further comprising:

between the fourth period and the scan period, tertiarily applying the initialization voltage to the first node; and tertiarily applying the reference voltage to the second node.

* * * * *